US010676848B1

(12) United States Patent
Sakuma et al.

(10) Patent No.: US 10,676,848 B1
(45) Date of Patent: Jun. 9, 2020

(54) SEWING MACHINE NEEDLE CLAMPING DEVICE

(71) Applicant: SUZUKI MANUFACTURING, LTD., Yamagata (JP)

(72) Inventors: Tohru Sakuma, Yamagata (JP); Mitsuharu Suzuki, Yamagata (JP)

(73) Assignee: SUZUKI MANUFACTURING, LTD., Yamagata (JP)

( * ) Notice: Subject to any disclaimer, the term of this patent is extended or adjusted under 35 U.S.C. 154(b) by 0 days.

(21) Appl. No.: 16/094,388

(22) PCT Filed: Aug. 29, 2017

(86) PCT No.: PCT/JP2017/030923
§ 371 (c)(1),
(2) Date: Oct. 17, 2018

(87) PCT Pub. No.: WO2019/043785
PCT Pub. Date: Mar. 7, 2019

(51) Int. Cl.
*D05B 55/02* (2006.01)

(52) U.S. Cl.
CPC ..... *D05B 55/02* (2013.01)

(58) Field of Classification Search
CPC ..... D05B 55/00; D05B 55/06; D05B 55/10; D05B 55/16; D05C 1/06; D05C 1/065; D05C 3/02; D05C 11/04
See application file for complete search history.

(56) References Cited

U.S. PATENT DOCUMENTS

| | | | | | |
|---|---|---|---|---|---|
| 204,294 | A | * | 5/1878 | Cook et al. | D05B 29/12 112/226 |
| 413,680 | A | * | 10/1889 | Parkhurst | |
| 498,212 | A | * | 5/1893 | Laskey | D05B 55/02 112/226 |
| 2,878,765 | A | * | 3/1959 | Gegauf | D05B 29/12 112/240 |
| 2,985,127 | A | * | 5/1961 | Reeber et al. | D05B 29/12 112/240 |

(Continued)

FOREIGN PATENT DOCUMENTS

| | | | |
|---|---|---|---|
| JP | S6226133 | A | 2/1987 |
| JP | 2004-121280 | A | 4/2004 |
| JP | 2007-151777 | A | 6/2007 |

*Primary Examiner* — Ismael Izaguirre
(74) *Attorney, Agent, or Firm* — Bacon&Thomas, PLLC

(57) ABSTRACT

A sewing machine needle is attached, fixed or exchanged to a needle clamp firmly and easily. The needle clamp 5 for clamping the sewing machine needle 3 has an accommodating recessed part 7 which accommodates a needle shank 15 of the sewing machine needle, a clamp lever 19 which has a clamp arm 21 which engages to the needle shank, is freely opened and closed and is fixed to a clamp lever abaft 17 which is fitted loosely to an elongate hole 13*b* which is bored at the needle clamp for the accommodating recessed part and a needle clamp spring 23 which repels elastically the clamp lever to an outer direction of a straight line which links a central point N of the needle shank and a central point of the clamp lever shaft, end the cam 71 is provided in the needle clamp 5, and the cam follower 70 which engages to the cam 71 is provided in the clamp wan 21, and the elongate hole has three surfaces that the can follower climbs over the cam and moves as the movement path of the clamp lever shaft which becomes a rotation center P of the clamp lever.

6 Claims, 29 Drawing Sheets

(56) References Cited

U.S. PATENT DOCUMENTS

| | | | | | |
|---|---|---|---|---|---|
| 3,277,854 | A * | 10/1966 | Ramon | ..... | D05B 55/02<br>112/226 |
| 5,143,006 | A * | 9/1992 | Jimenez | ..... | D05B 29/12<br>112/226 |
| 7,428,876 | B2 * | 9/2008 | Hillenbrand | ..... | D05B 55/14<br>112/226 |
| 7,971,544 | B2 * | 7/2011 | Hillenbrand | ..... | D05C 11/04<br>112/226 |

* cited by examiner

SEWING MACHINE NEEDLE CLAMPING DEVICE

FIELD OF THE ART

The present invention relates to a sewing machine needle clamping device, and particularly relates to the sewing machine needle clamping device for attaching, fixing or exchanging a sewing machine needle of such as a lock stitch sewing machine, a serger, a double chain stitch sewing machine, or a cover stitch sewing machine to a needle clamp firmly and easily.

BACKGROUND OF THE ART

Conventionally, in the lock stitch sewing machine, the serger, the double chain stitch sewing machine, or the cover stitch sewing machine, etc., it is well known that a cloth which should be sewed is sandwiched between a throat plate and a presser foot which is pressed by a presser bar and is fed stitch by stitch by a feed dog mechanism, and stitches are formed on the cloth by the sawing machine needle and a shuttle hook or a looper as a loop capturing device.

In the meantime, the shuttle book or the looper as the loop capturing device and the feed dog mechanism are driven by each drive mechanism from a lower shaft which is a drive shaft. On the other hand, the swing machine needle is screwed by a screw to the needle clamp which is attached to the needle bar which is driven with an upper shaft which is transferred from the lower shaft by a lower shaft pulley, a timing belt and an upper shaft pulley (cf: Patent document Nos. 1-4).

PRIOR ART DOCUMENT

Patent Document

[Patent document No. 1] JP H05-085380 U
[Patent document No. 2] JP 2004-121280 A
[Patent document No. 3] JP 2007-151777 A
[Patent document No. 4] JP 3181298 U

SUMMARY OF THE INVENTION

Problem to be Solved by the Invention

However, in such the sewing machine needle clamping device, on the one hand, while holding a sewing machine needle shank at an attaching position of vertical direction in an inside of the needle clamp, on the other hand, it is necessary to screw the sewing machine needle by the screw to the needle clamp by joining and holding an attaching flat surface which is provided on a peripheral surface of the sewing machine needle shank to an attaching flat surface of the inside of the needle clamp. In this case, an operation which is necessary to screw one or multiple sewing machine needles by the screw to each needle clamp by joining and holding to the attaching flat surface of the inside of the needle clamp firmly by a screwdriver is a complicated work for operators of the sewing machine.

The present invention was conducted to solve these disadvantages. The object of the present invention is to provide the sewing machine needle clamping device that such the operation which has to screw the sewing machine needle by the screw to the needle clamp firmly by a screwdriver is unnecessary and the mechanism is simplified and the operation is performed by one-touch operation and the sewing machine needle of the sewing machine is attached and fixed to the needle clamp firmly and easily.

Means for Solving the Problems

In order to achieve such the objects, a sewing machine needle clamping device of the present invention for attaching a sewing machine needle to an accommodating recessed part of a needle clamp comprises the needle clamp which has, the accommodating recessed part which accommodates a needle shank of the sewing machine needle by joining an attaching flat surface to a bottom portion, a swingable clamp lever which has a clamp arm which engages to the needle shank of the sewing machine needle and is freely opened and closed for the accommodating recessed part and is fixed to a clamp lever shaft which is fitted loosely into an elongate hole which is bored at the needle clamp, and a needle clamp spring which repels elastically the clamp lever to an outer direction of a straight line which links a central point of the needle shank of the sewing machine needle and a central point of the clamp lever shaft, wherein the clamp an has a force acting locking part, which moves around on a peripheral surface of the needle shank of the sewing machine needle against the elasticity of the needle clamp spring when swinging the clamp lever to a clamping direction in the state that the needle shank of the sewing machine needle is engaged to the accommodating recessed part and butted against an attaching position of a vertical direction, and passes a branch point position that the elasticity of the needle clamp spring becomes maximum, and holds a stable clamping state by the elasticity of the needle clamp spring, and a cam is provided in the needle clamp, a cam, follower which engages to the cam is provided in the clamp arm, and the elongate hole has three surfaces that the can follower climbs over the cam and moves as a movement path of the clamp lever shaft which becomes a rotation center of the clamp lever.

Besides, in the sewing machine needle clamping device of the present invention, a lock piece is provided in the needle clamp movably in a direction which is perpendicular to the direction of an axis of the needle, and a lock piece stopper which guides the lock piece to a direction, which is perpendicular to a direction of an axis of the sewing machine needle is provided, a clamp stopper which prevents the opening of the clamp lever by locking to the lock piece when closing the clamp lever is provided in the clamp lever, and a lock release button which releases the lock of the lock piece and the clamp stopper when opening the clamp lever is provided in the clamp lever.

Besides, a sewing machine needle clamping device of the present invention for attaching a sewing machine needle to an accommodating recessed part of a needle clamp comprises the needle clamp which has, the accommodating recessed part which accommodates a needle shank of the sewing machine needle by joining an attaching flat surface to a bottom portion, a swingable clamp lever which has a clamp arm which engages to the needle shank of the sewing machine needle and is freely opened and closed for the accommodating recessed part and is fixed to a clamp lever shaft which is fitted loosely into an elongate hole which is bored at the needle clamp, and a needle clamp spring which repels elastically the clamp lever to an outer direction of a straight line which links a central point of the needle shank of the sewing machine needle and a central point of the clamp lever shaft, wherein the clamp arm has a force acting locking part, which moves around on a peripheral surface of the needle shank of the sewing machine needle against the elasticity of the needle clamp spring when swinging the clamp lever to a clamping direction in the state that the needle shank of the sewing machine needle is engaged to the accommodating recessed part and butted against an attaching position of a vertical direction, and passes a branch point position that the elasticity of the needle clamp spring becomes maximum, and holds a stable clasping state by the elasticity of the needle clamp spring, and the needle clamp which attaches the sewing machine needle is formed in an inner shape which adjusts to the needle shank or an outer shape of the needle to prevent that the needle slips out of the needle clamp when the needle penetrates into a cloth and then the needle come out of the cloth.

Besides, in the sewing machine needle clamping device of the present invention, a needle clamp forgetting prevention spring which repels elastically the needle to a direction that the needle separates from the accommodating recessed part is provided in the needle clamp which attaches the sewing machine needle when the clamp lever is opened.

Besides, in the swing machine needle clamping device of the present invention, an attaching hole which adjusts to a D-shaped cross-sectional shape including an attaching flat surface of an upper end of the needle shank of the sewing machine needle is formed to be able to attach the sewing machine needle at the time of a direction of the attachment of the needle where the attaching flat surface of the needle shank is joined to the attaching flat surface of the accommodating recessed part in the needle clamp which attaches the sewing machine needle.

Effect of the Invention

According to a sewing machine needle clamping device of the present invention, this device can provide the basic merits that the mechanism is simplified and the operation is performed by one-touch operation of small number of times, and the sewing machine needle of such as the lock stitch sewing machine, the merger, the double chain stitch sewing machine, or the cover stitch sewing machine can be attached, fixed or exchanged to the needle clamp firmly and easily.

According to the sewing machine needle clamping device of the present invention, in addition to the above basic merits, when the sewing machine needle is clamped, the wear-out due to the engagements of many times of the needle shank face that a maker name of the sewing machine needle and an engraved mark are engraved and a force acting locking part face of the clamp arm is eliminated, and the sewing machine needle can be clamped to the needle clamp certainly.

According to the sewing machine needle clamping device of the present invention, in addition to the above basic merits, when the clamp lever is closed, the clamp lever is opened by the unintentional movement in the lateral direction and the back-and-forth direction of the needle and the malfunction that claming of the needle is released occurs, and this device can function as a safety device which prevents that the sewing machine needle breaks and disperses by the collision with other parts.

According to the sewing machine needle claiming device of the present invention, in addition to the above basic merits, when the sewing machine needle penetrates into the cloth that the needle is hard to pierce in other words, when the sewing machine needle penetrates into the cloth which has the large friction and then the sewing machine needle come out of the cloth, this device can prevent that the sewing machine needle slips out of the needle clamp by the frictional force with the cloth.

According to the sewing machine needle clamping device of the present invention, in addition to the above basic merits, when the needle is attached to the needle clamp, the safety device which does not drop the sewing machine needle is provided. On the other hand, when the clamp lever is opened, prevention to forget clamping can be attempted because the sewing machine needle drops from the accommodating recessed part.

According to the sewing machine needle clamping device of the present invention, in addition to the above basic merits, the sewing machine needle can be attached to the accommodating recessed part only when a direction of the sewing machine needle where the attaching flat surface of the needle shank is joined to the attaching flat surface of the accommodating recessed part is attached, and the attachment awl be performed certainly.

BRIEF DESCRIPTION OF THE DRAWINGS

FIG. 2 (*b*) A bottom view of the sewing machine needle clamping device by the present invention which clamps the sewing machine needle to the needle clamp.

FIG. 2 (*c*) A back view of the sewing machine needle clamping device by the present invention which clamps the sewing machine needle to the needle clamp.

FIG. 2 (*d*) A perspective view of the sewing machine needle clamping device by the present invention which clamps the sewing machine needle to the needle clamp.

FIG. 4 (*b*) A bottom view of the sewing machine needle clamping device by the present invention in a state immediately after clamping operation of the sewing machine needle to the needle clamp.

FIG. 4 (*c*) A bottom view of the sewing machine needle clamping device by the present, invention in a state after further continuing a clamping operation of the sewing machine needle to the needle clamp.

FIG. 4 (*d*) A bottom view of the sewing machine needle clamping device by the present invention in a state which completed a clamping operation of the sewing machine needle to the needle clamp.

FIG. 5 (*b*) A motion schematic view of the sewing machine needle clamping device by the present invention in a state immediately after clamping operation of the sewing machine needle to the needle clamp.

FIG. 5 (*c*) A motion schematic view of the sewing machine needle clamping device by the present invention in a state after further continuing a clamping operation of the sewing machine needle to the needle clamp.

FIG. 5 (*d*) A motion schematic view of the sewing machine needle clamping device by the present invention in a state which completed a clamping operation of the sewing machine needle to the needle clamp.

FIG. 5 (*e*) An explanatory view showing the movement path of the claw lever shaft in the elongate hole which is provided in the needle clamp of the sewing machine needle clamping device by the present invention. A bottom view and a partial enlarged view of the clamping device.

FIG. 6 (*b*) A bottom view of the sewing machine needle clamping device of the present invention which clamps the sewing machine needle to the needle clamp certainly and prevents the clamp release.

FIG. 6 (*c*) A bottom view of the sewing machine needle clamping device of the present invention which clamps the sewing machine needle to the needle clamp certainly and prevents the clamp release.

FIG. 6 (*d*) A perspective view of the sewing machine needle clamping device of the present invention which clamps the sewing machine needle to the needle clamp certainly and prevents the clamp release.

FIG. 8 (*b*) A perspective view of the sewing machine needle clamping device of the present invention which prevents forgetting clamping of the sewing machine needle.

FIG. 9 (*b*) A bottom view of the sewing machine needle clamping device of the present invention which performs an orientation work of the sewing machine needle certainly when clamping the sewing machine needle to the needle clamp certainly.

FIG. 9 (*c*) A bottom view of the sewing machine needle clamping device of the present invention which performs an orientation work of the sewing machine needle certainly when clamping the sewing machine needle to the needle clamp certainly.

FIG. 9 (*d*) A bottom view of the sewing machine needle clamping device of the present invention which performs an orientation work of the sewing machine needle certainly when clamping the sewing machine needle to the needle clamp certainly.

FIG. 9 (*e*) A perspective view of the sewing machine needle clamping device of the present invention which performs an orientation work of the sewing machine needle certainly when clamping the sewing machine needle to the needle clamp certainly.

FIG. 9 (*f*) A perspective view of the sewing machine needle clamping device of the present invention which performs an orientation work of the sewing machine needle certainly when clamping the sewing machine needle to the needle clamp certainly.

FIG. 9 (*g*) A bottom view of the sewing machine needle clamping device of the present invention which performs an orientation work of the sewing machine needle certainly when, clamping the sewing machine needle to the needle clamp certainly.

MODE FOR CARRYING OUT THE INVENTION

Figure 1:
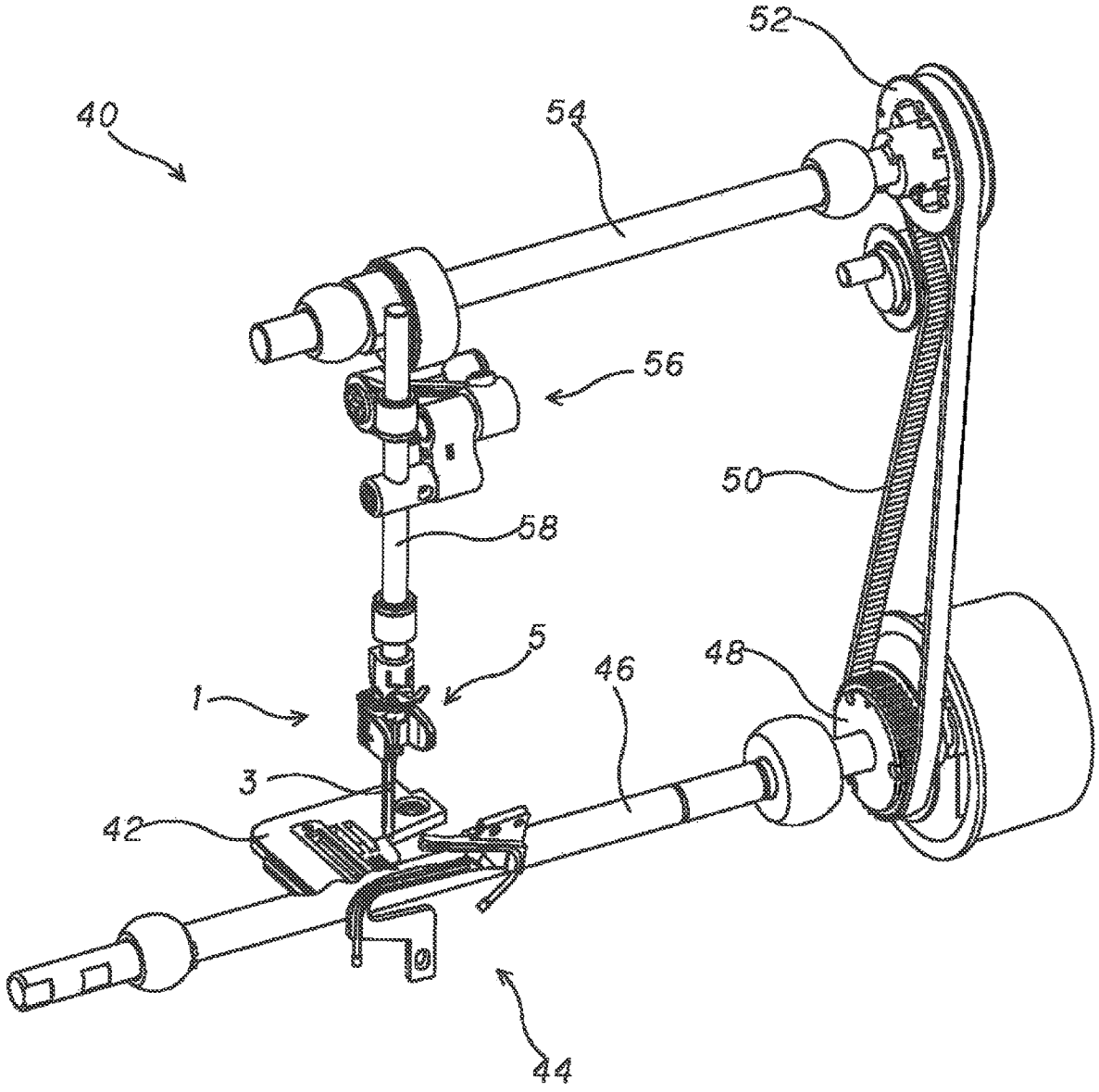
FIG. 1 A whole perspective view seeing from a front side of the sewing machine which attaches the sewing machine needle clamping device by the present invention.
Figure 2A:
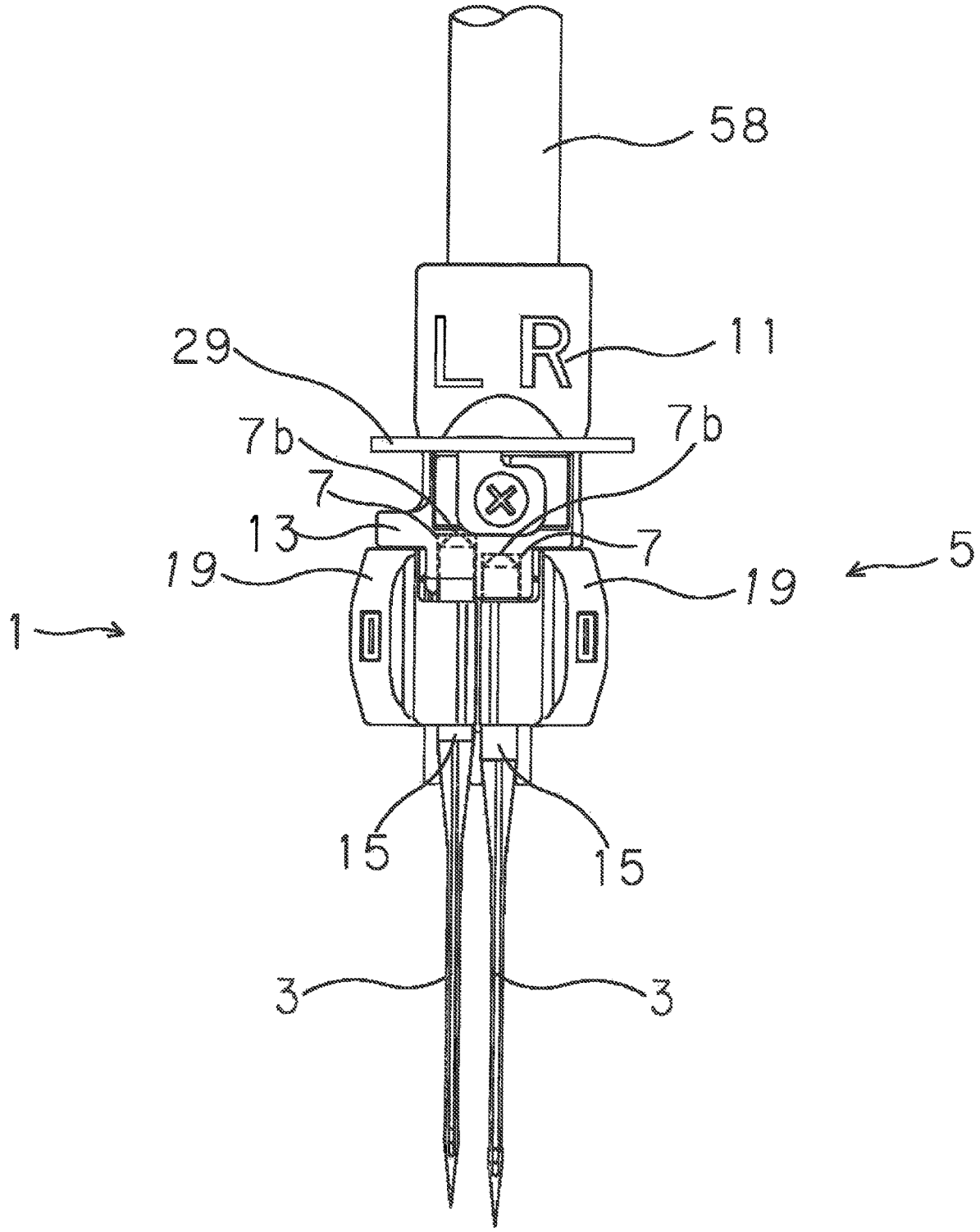
FIG. 2 (*a*) A front view of the sewing machine needle clamping device of the present invention which clamps the sewing machine needle to the needle clamp.
Figure 2B:
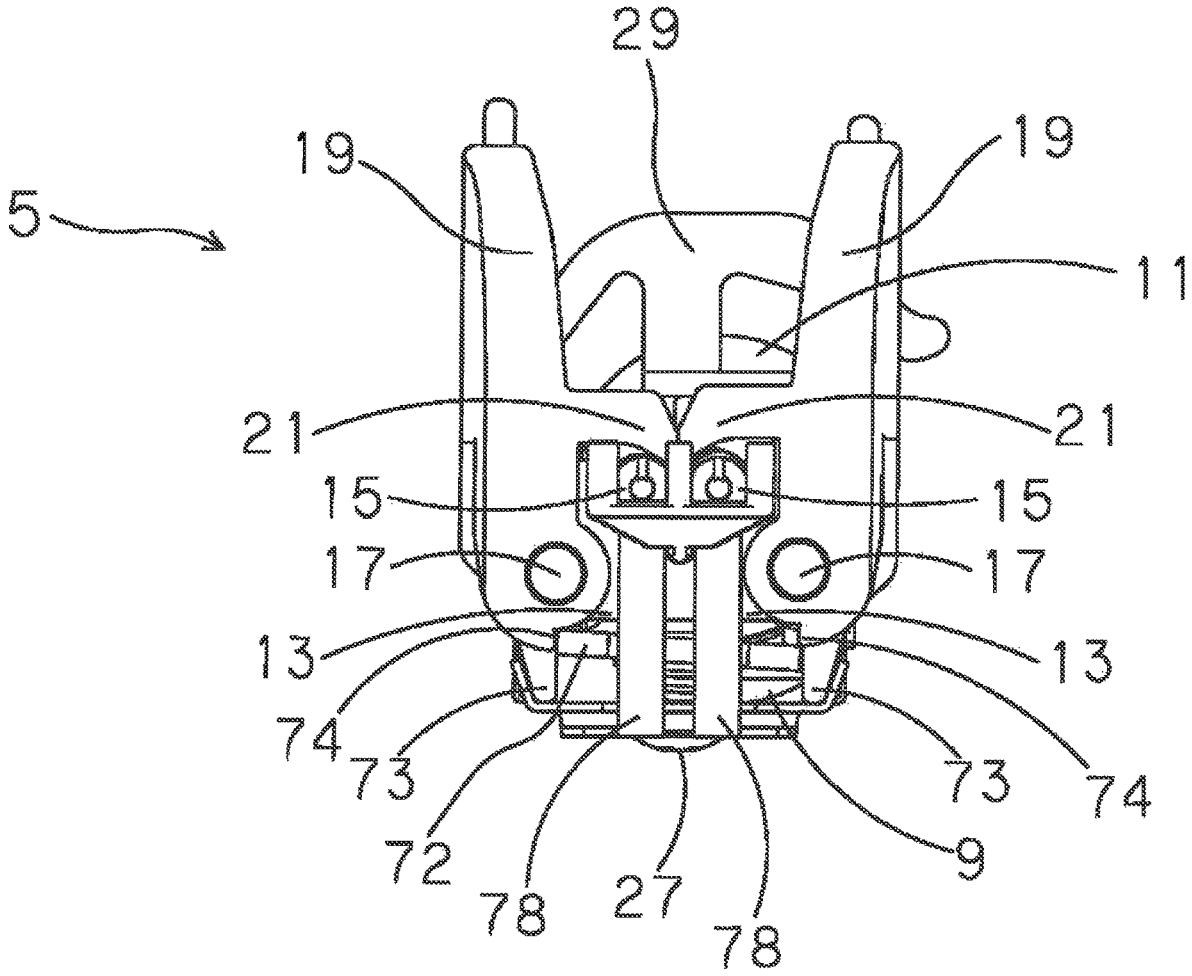
Figure 2C:
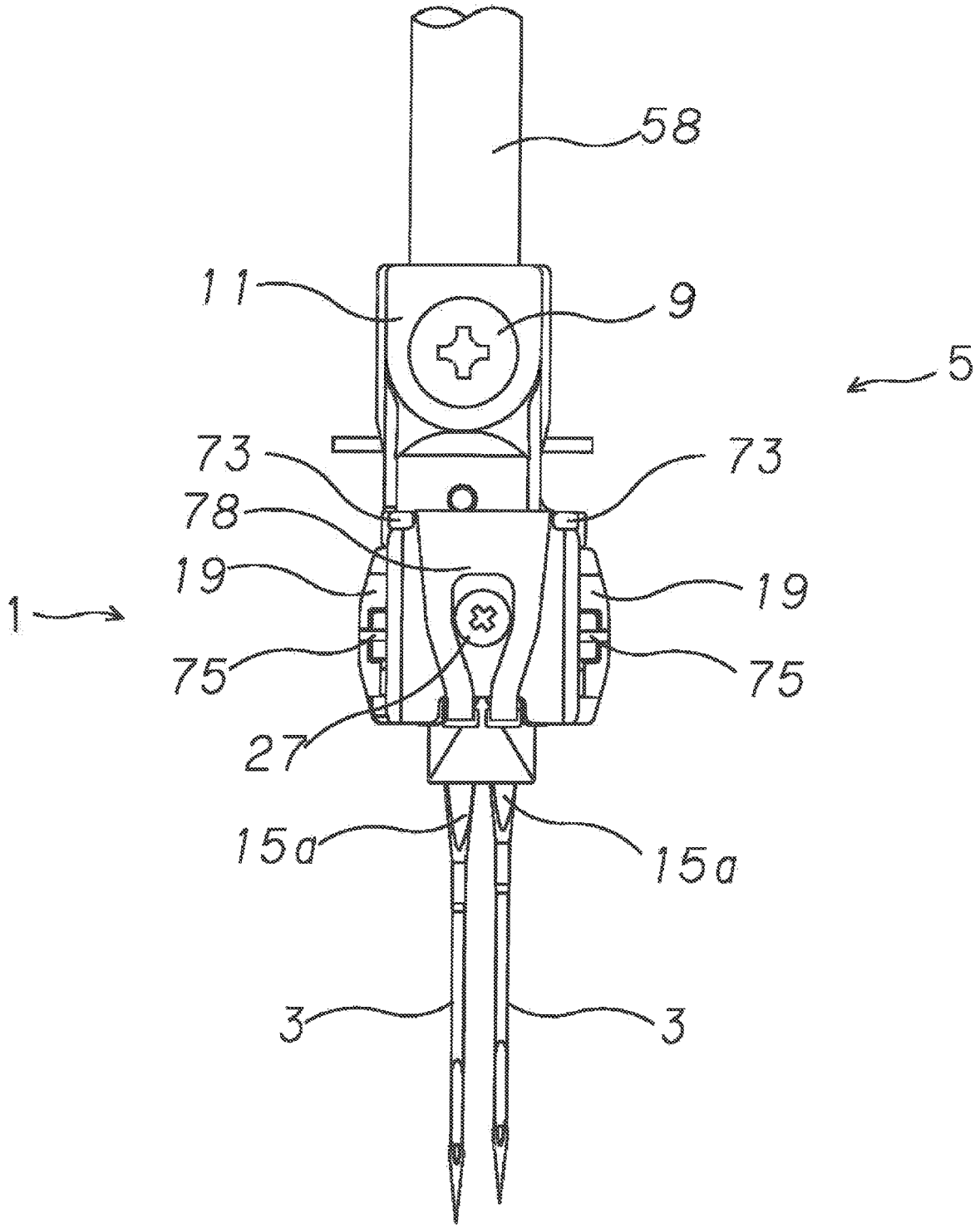
Figure 2D:
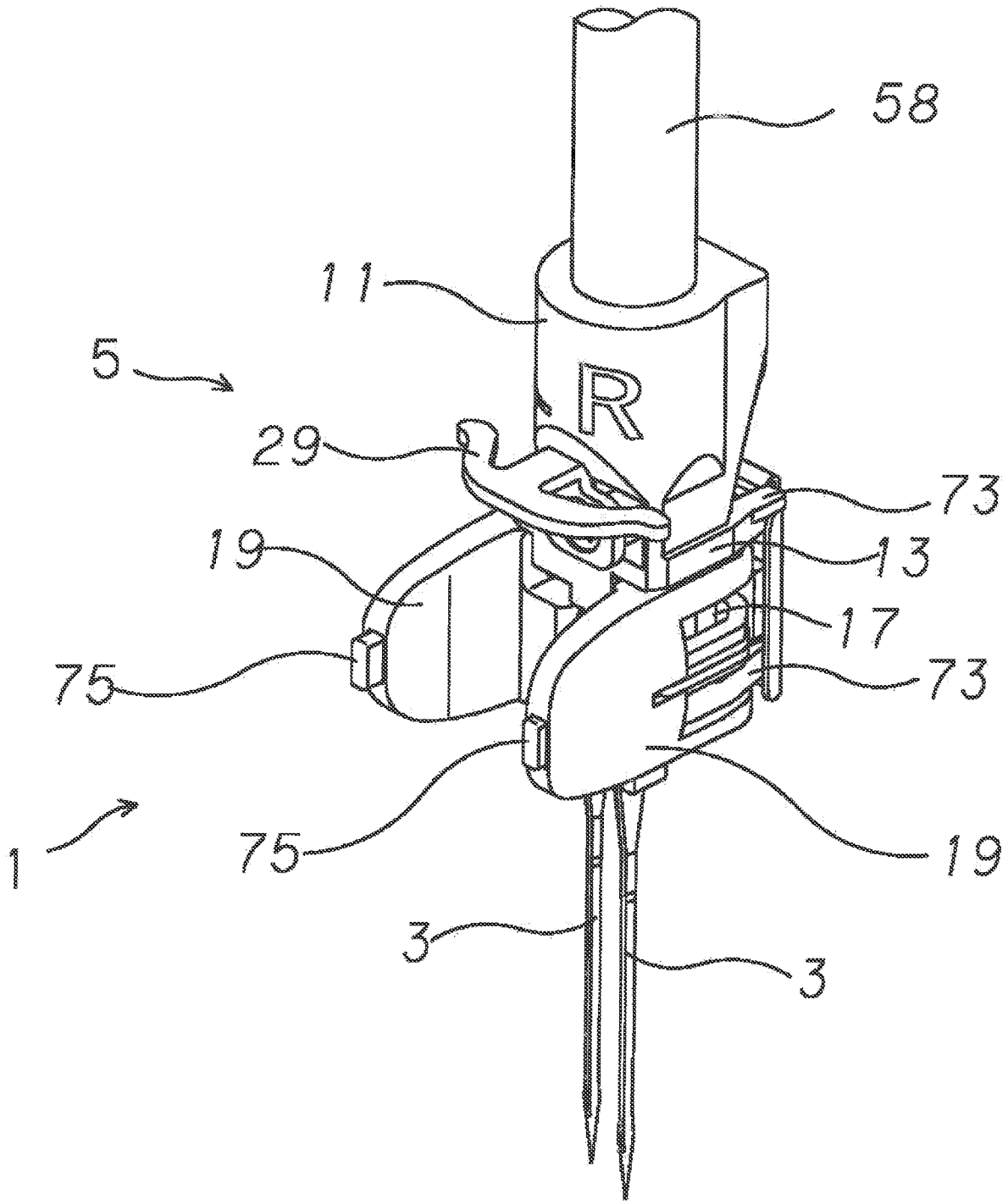
Figure 3A:
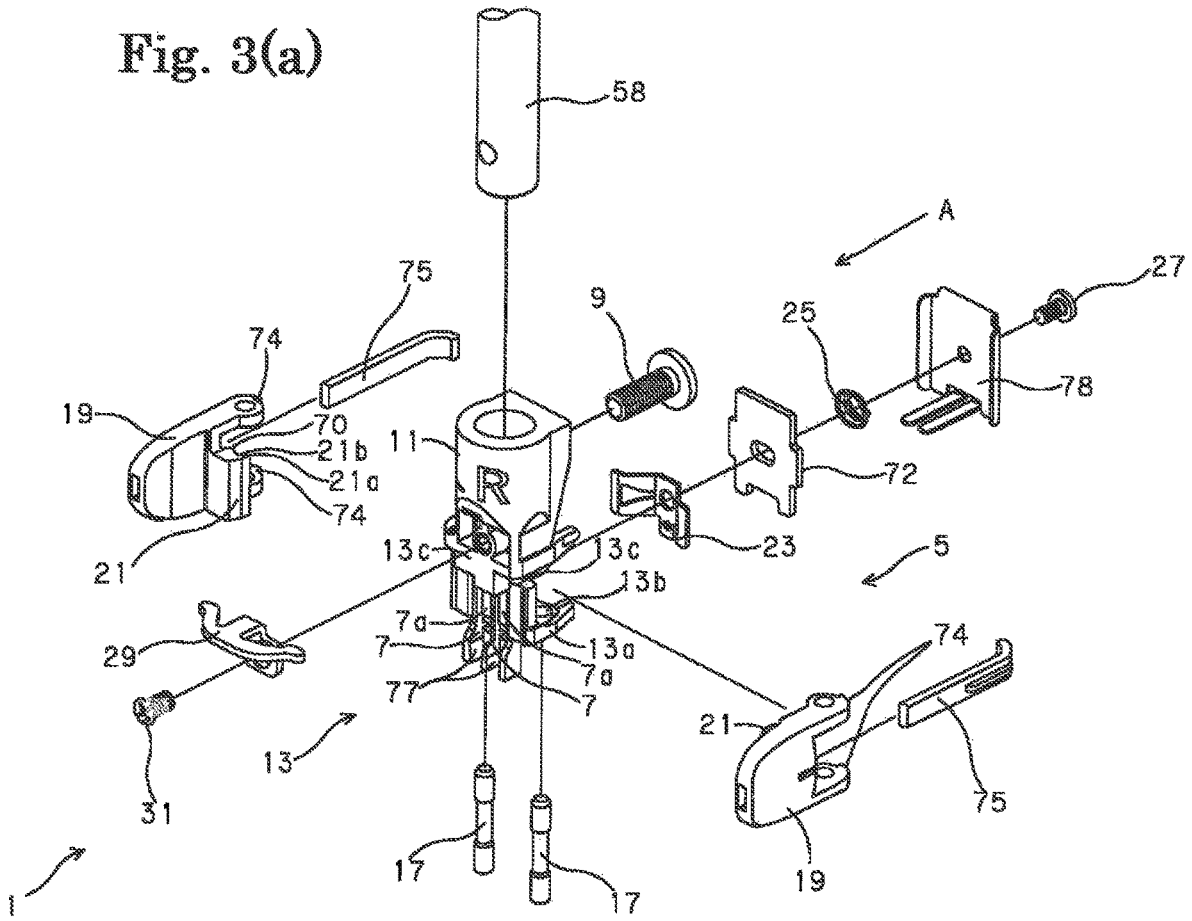
FIG. 3 (*a*) is an exploded perspective view of the sewing machine needle clamping device by the present invention, and (b) is a partial perspective view of the sewing machine needle clamping device seeing from a direction of an arrow A of (a).
Figure 3B:
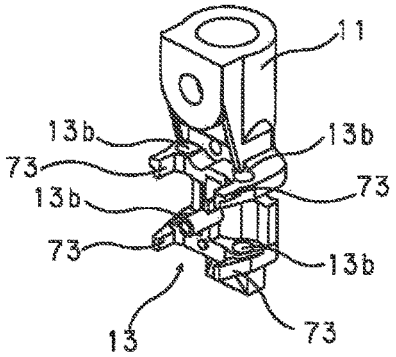
Figure 4A:
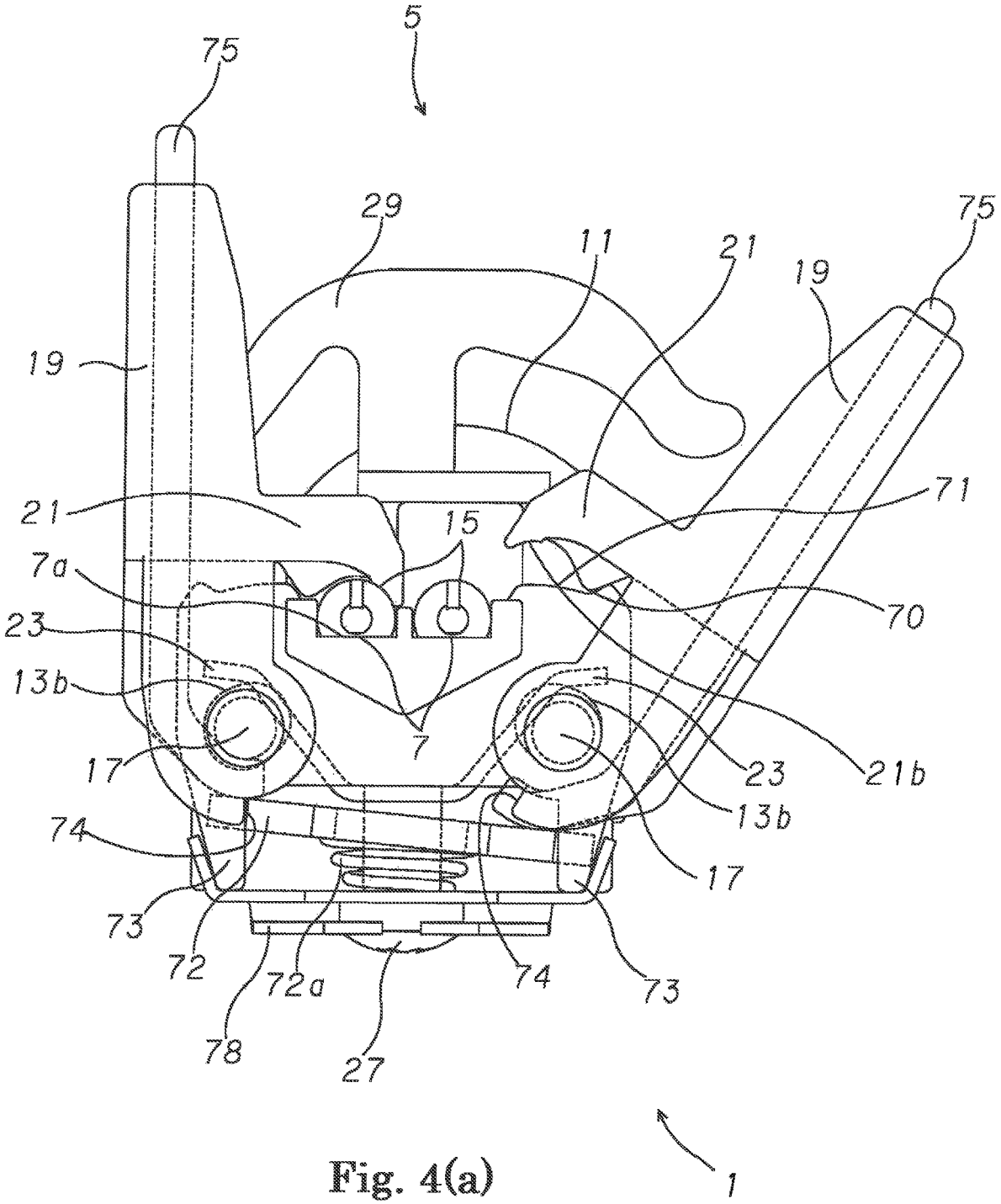
FIG. 4 (*a*) A bottom view of the sewing machine needle clamping device by the present invention in a state before clamping the sewing machine needle to the needle clamp.
Figure 4B:
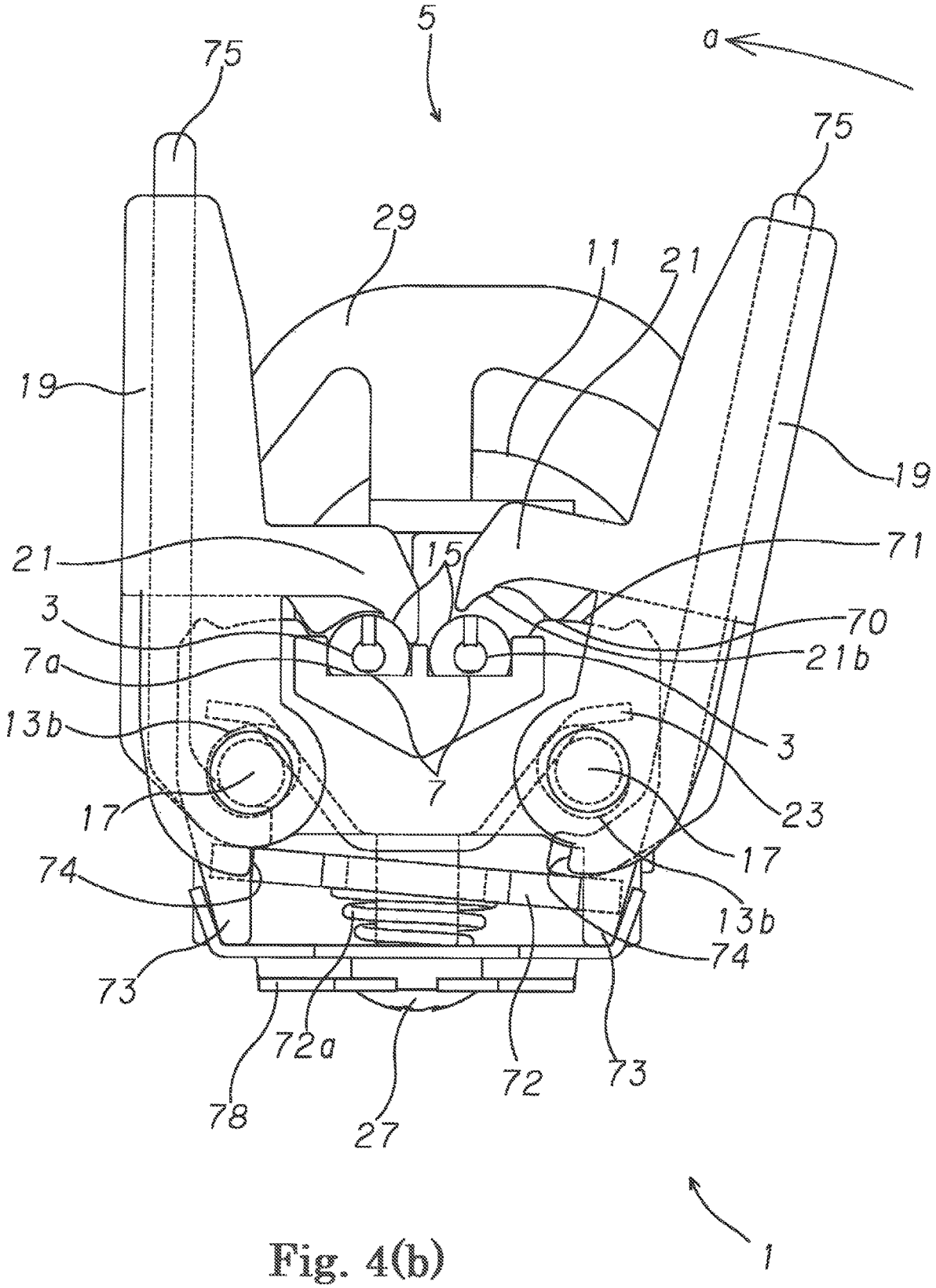
Figure 4C:
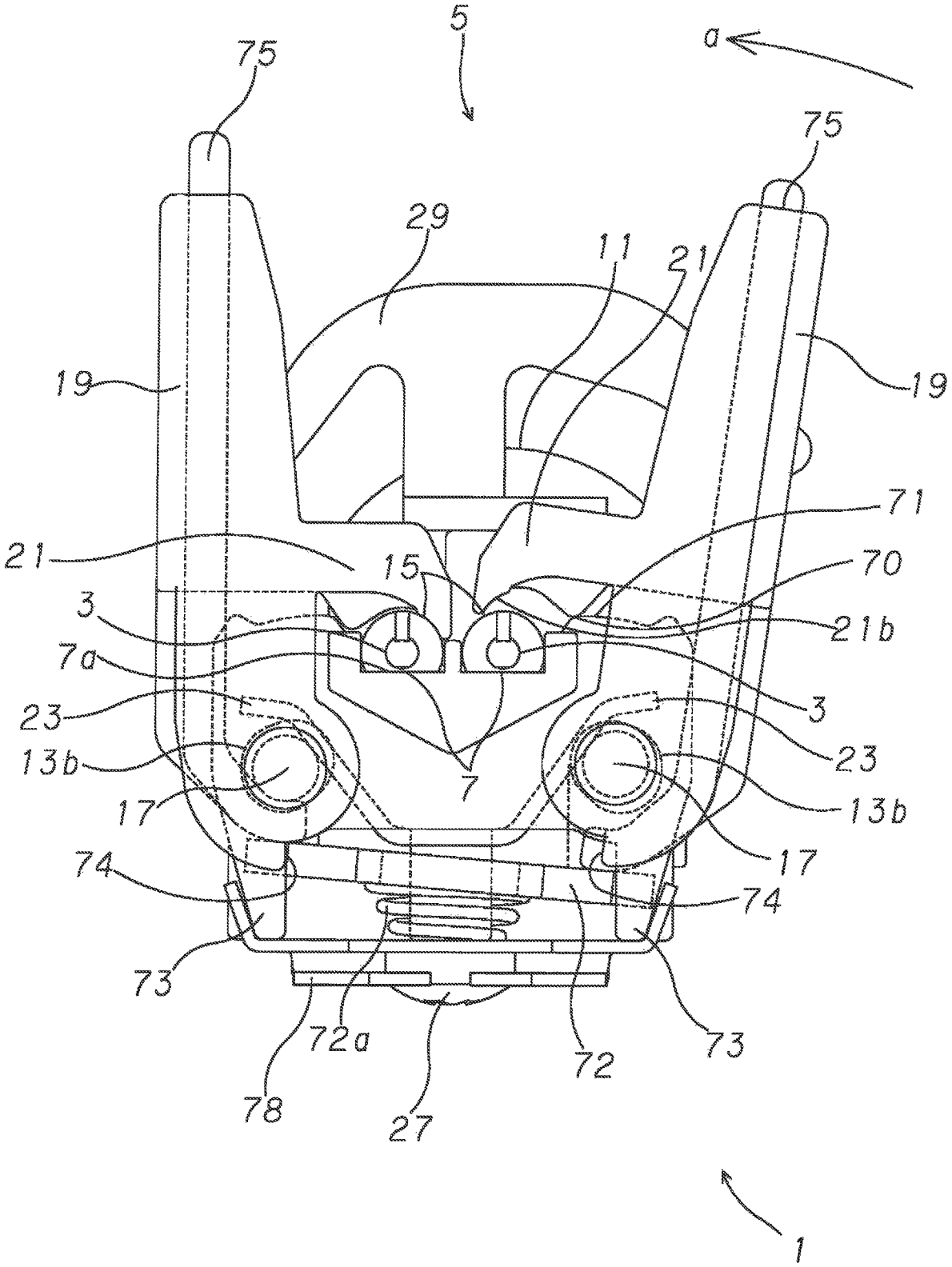
Figure 4D:
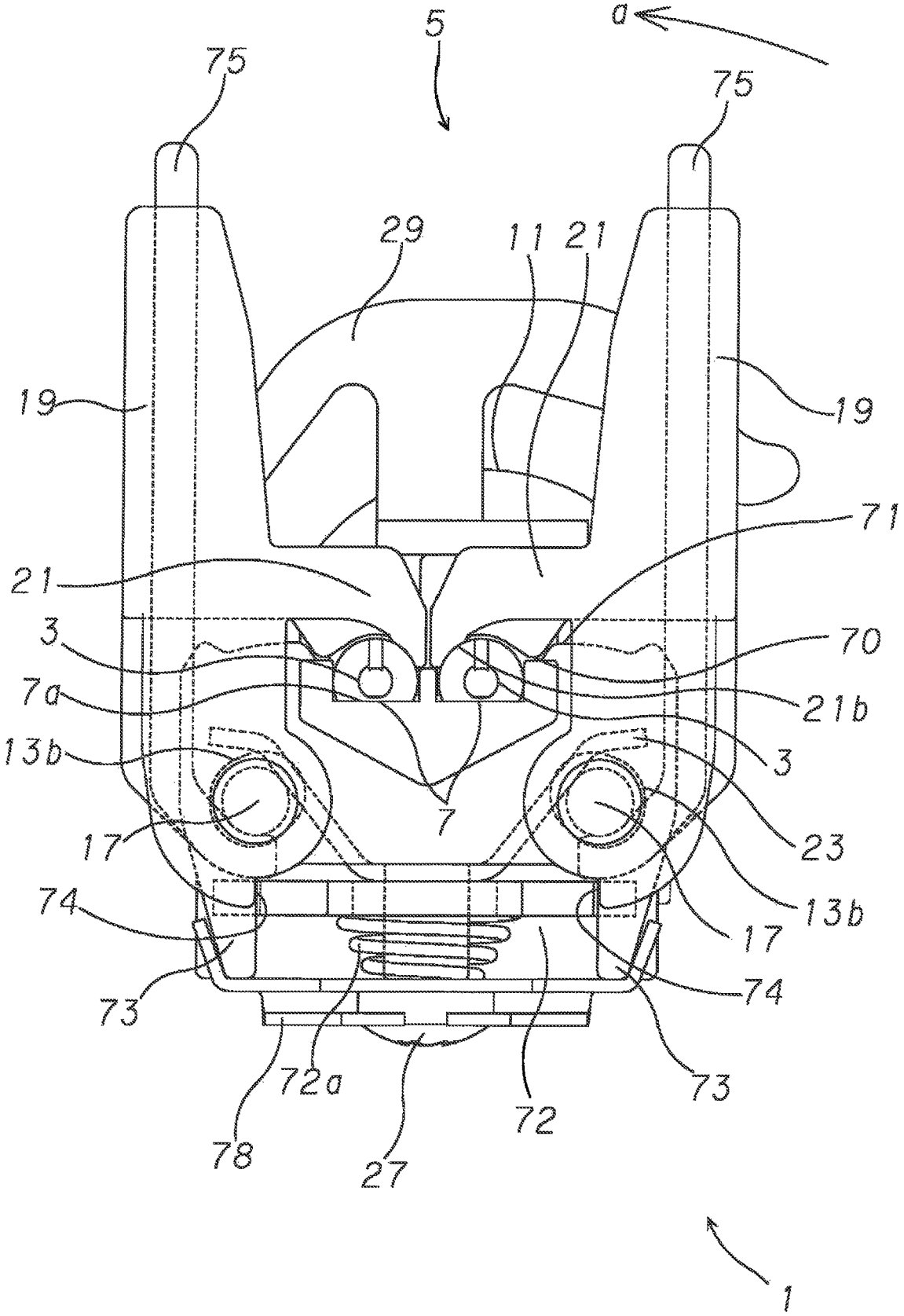
Figure 5A:
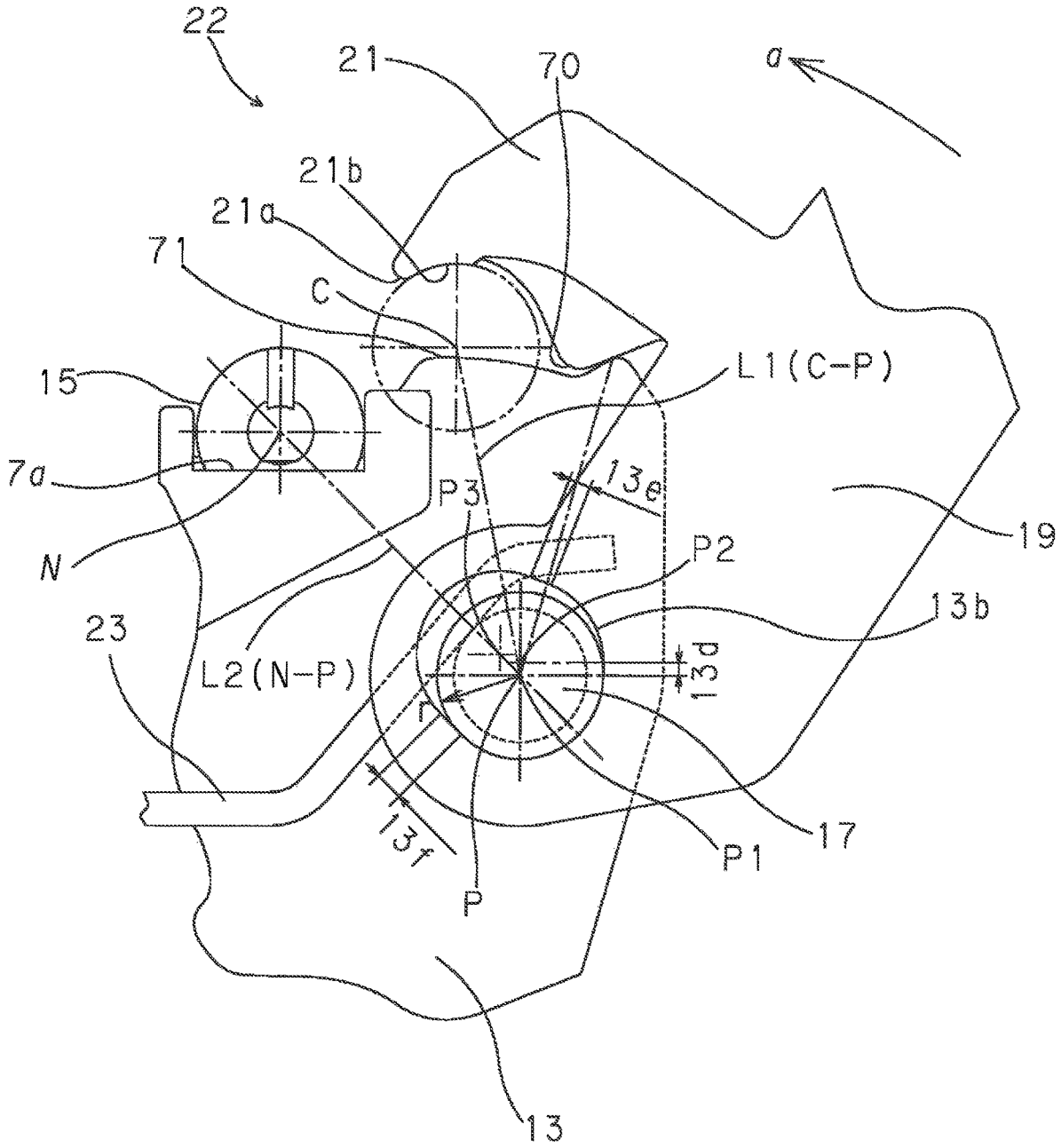
FIG. 5 (*a*) A motion schematic view of the sewing machine needle cleaving device by the present invention in a state before clamping the sewing machine needle to the needle clamp.
Figure 5B:
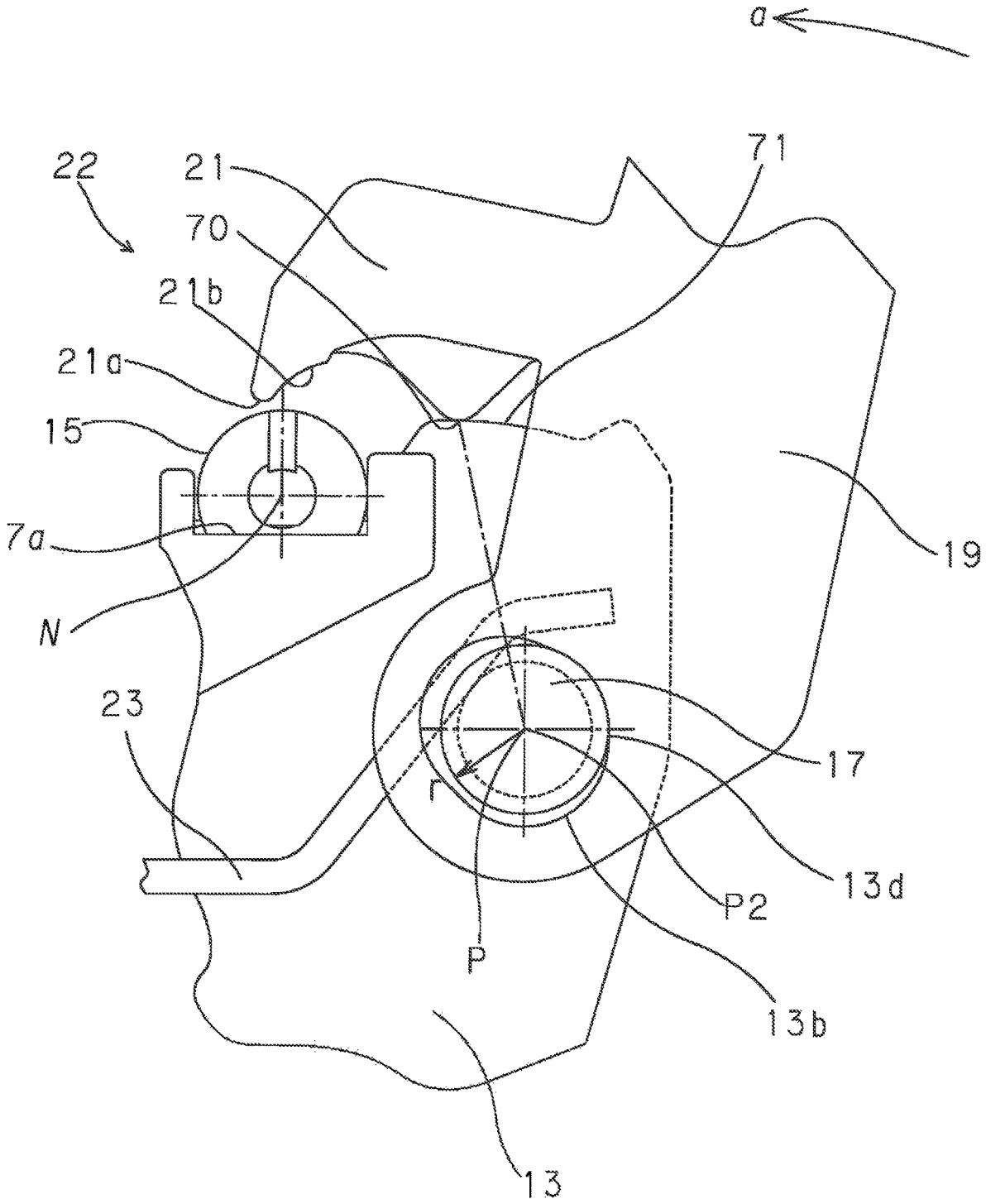
Figure 5C:
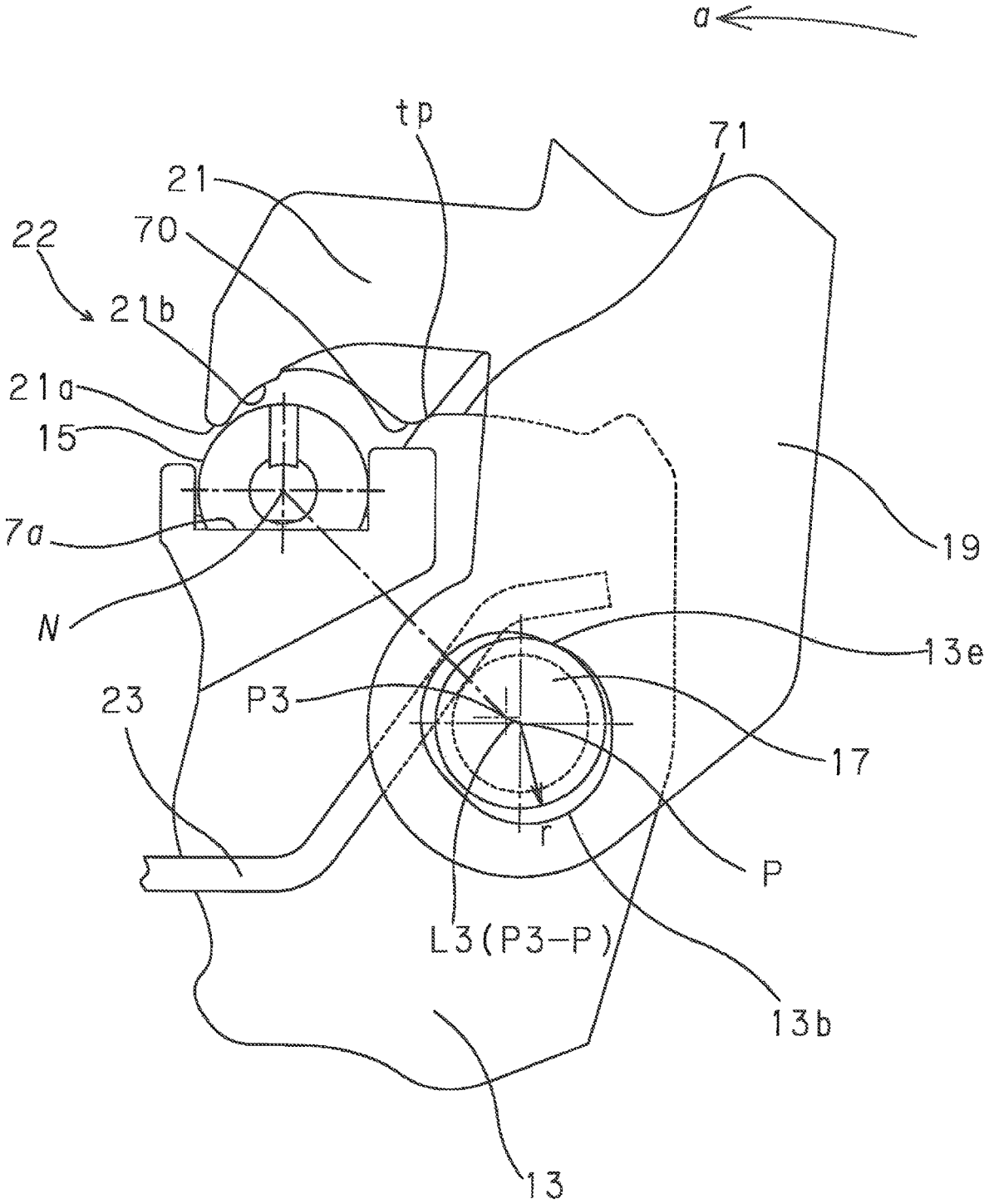
Figure 5D:
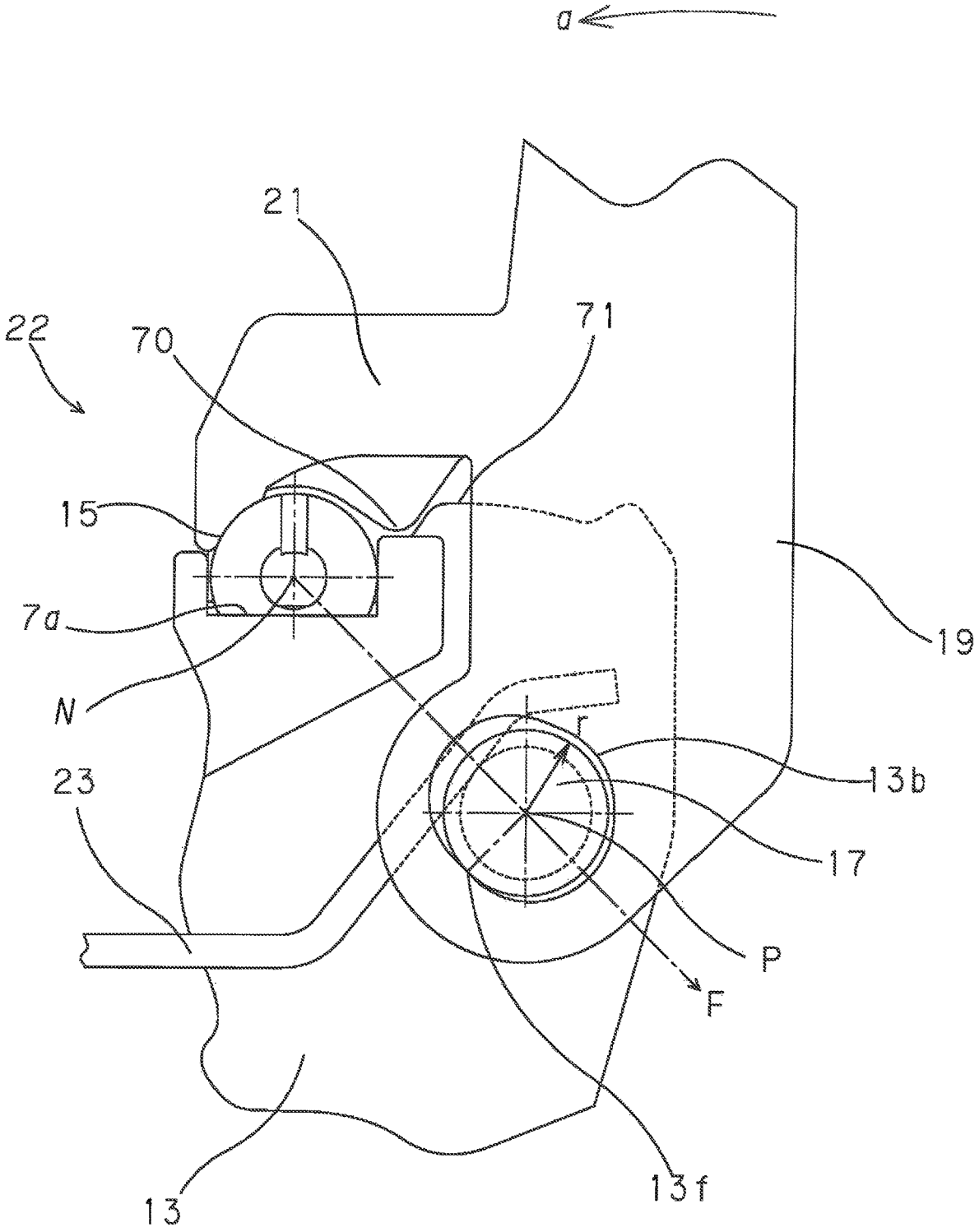
Figure 5E:
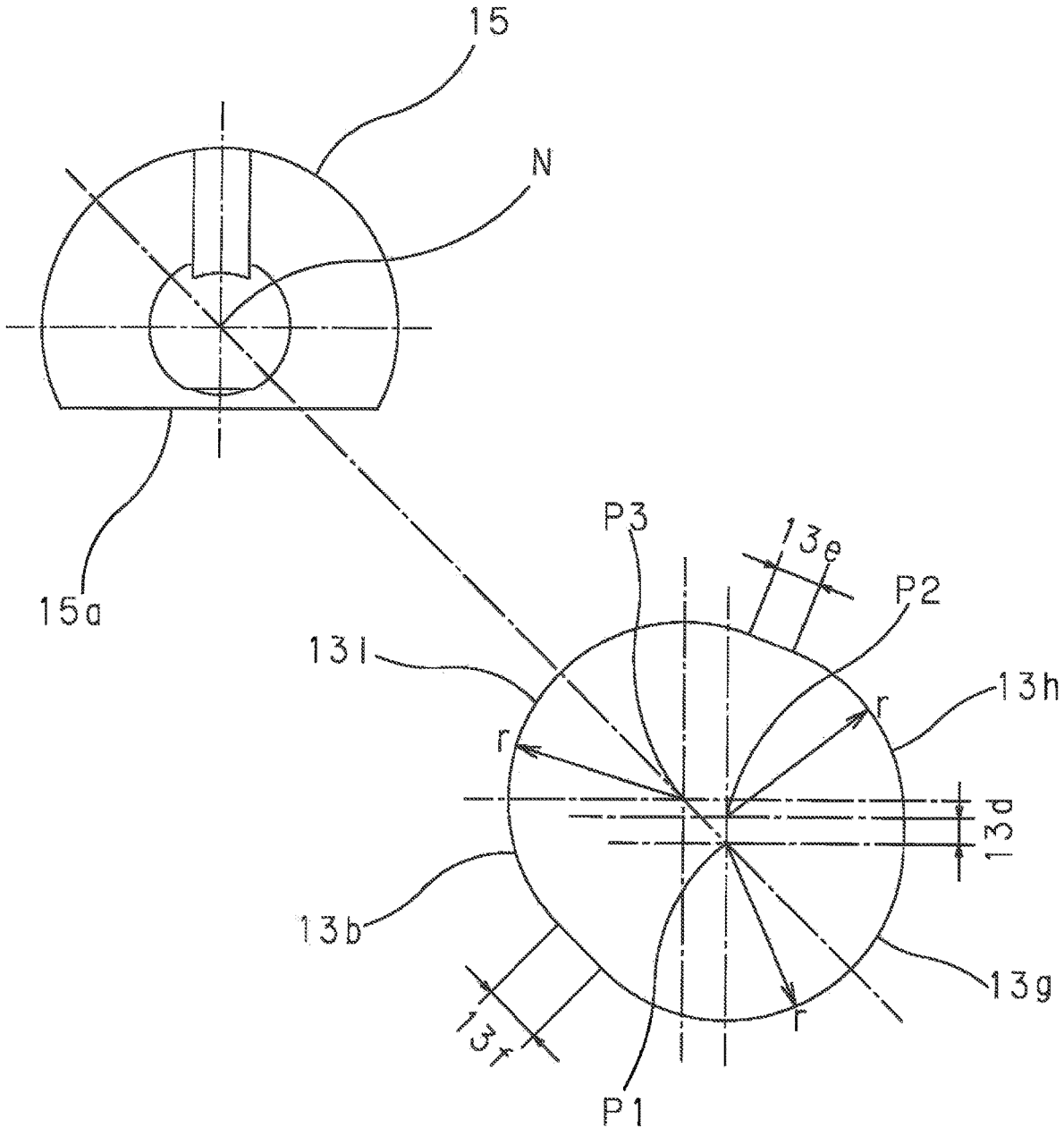
Figure 6A:
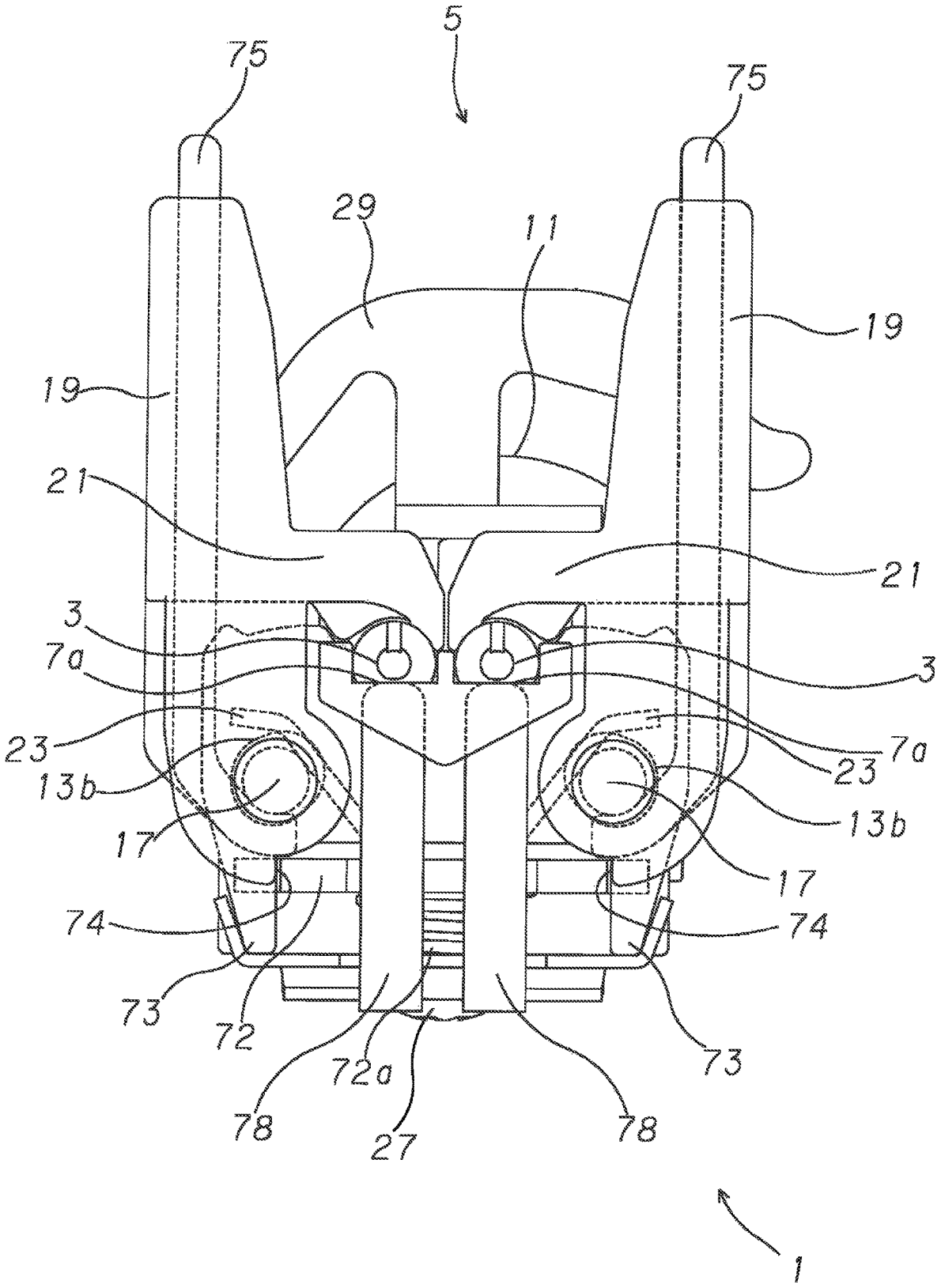
FIG. 6 (*a*) A bottom view of the sewing machine needle clamping device of the present invention which clamps the sewing machine needle to the needle clamp certainly and prevents the clamp release.
Figure 6B:
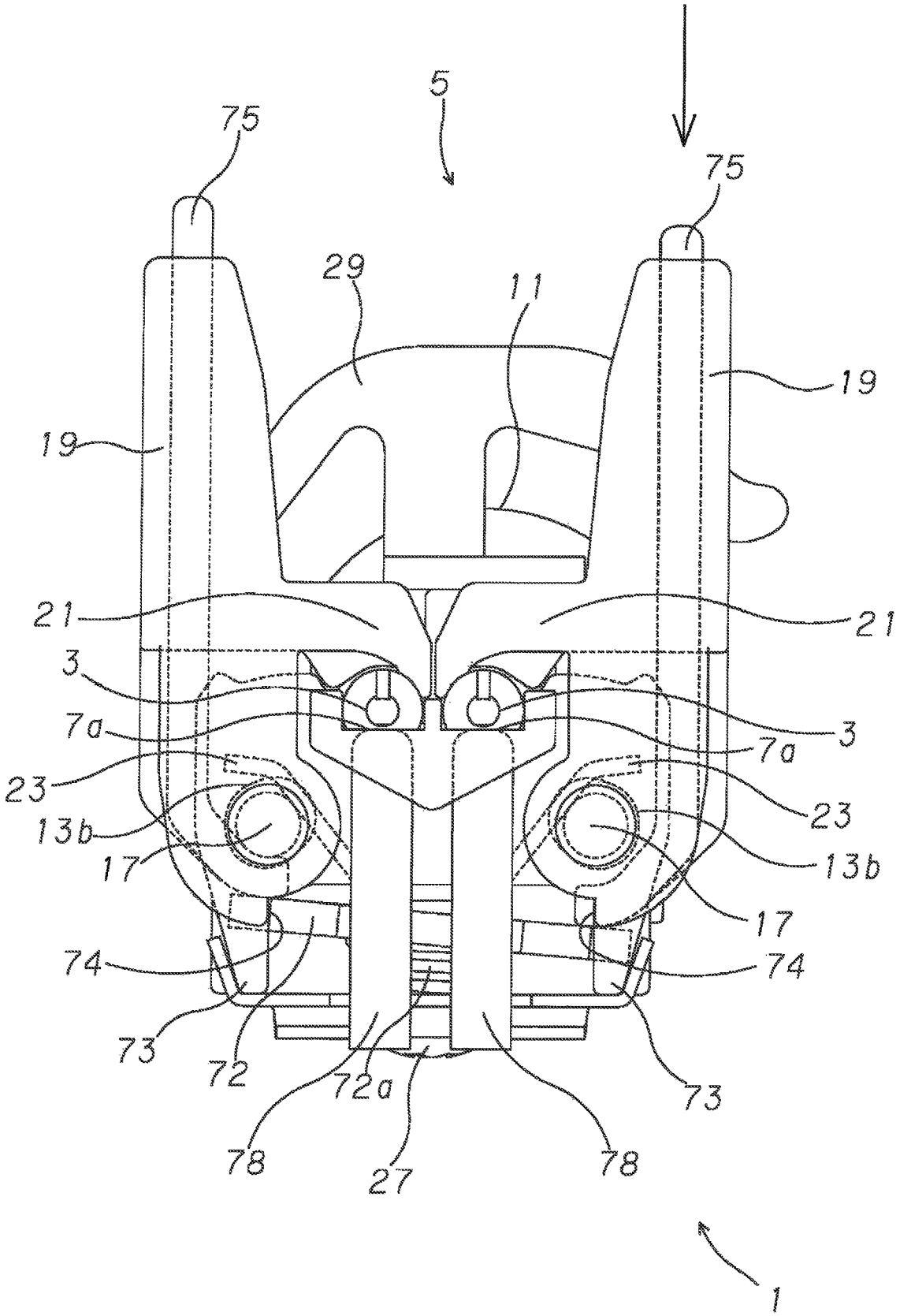
Figure 6C:
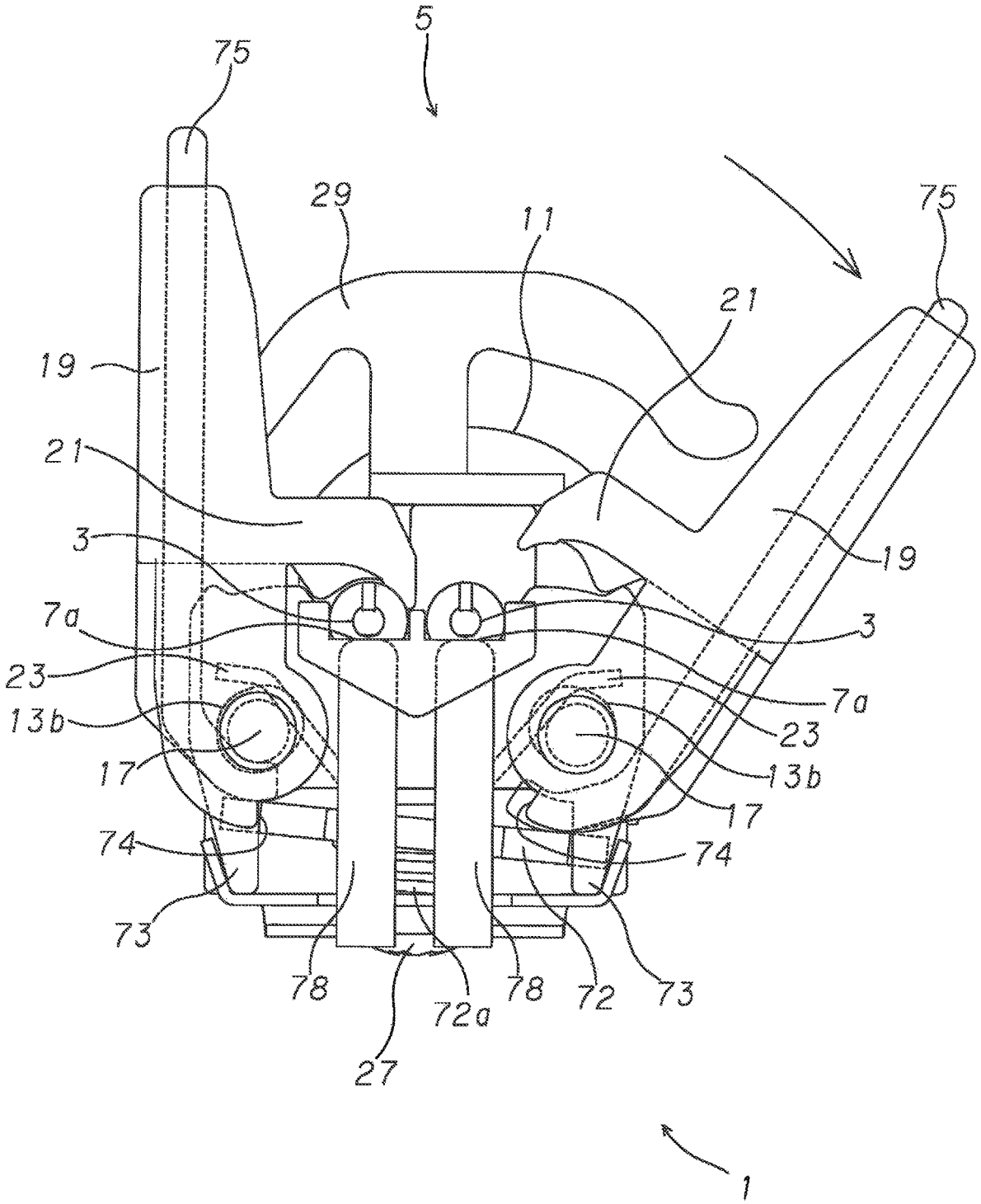
Figure 6D:
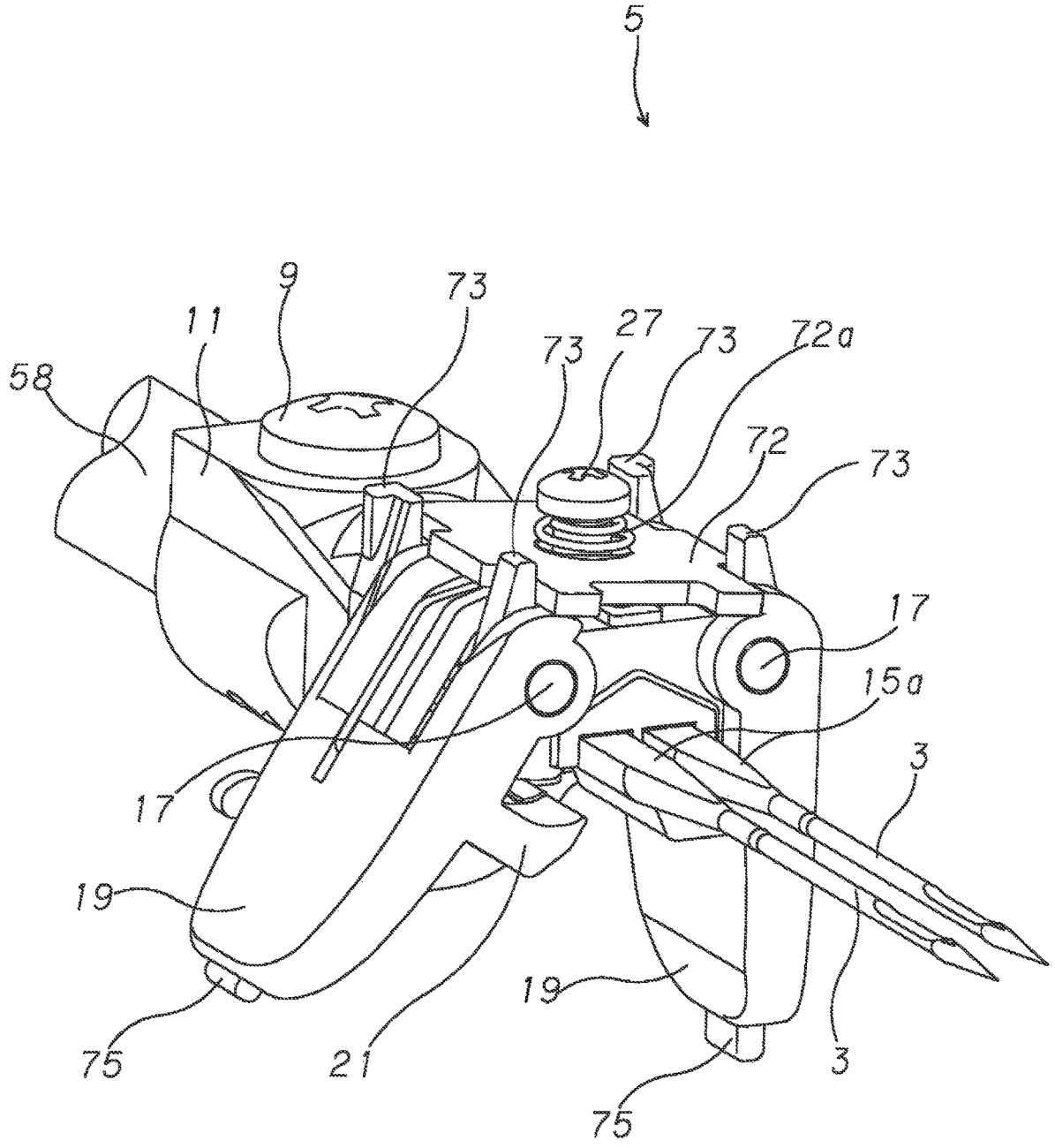

Hereinafter, the Some preferable embodiments that the oaring machine needle clamping device of the present invention is applied to a 2 (two) needles 4 (four) threads serger (hemstitch sewing machine) are explained in detail by referring to the drawings.

As she in FIG. 1, in this 2 needles 4 threads hemstitch sewing machine (Berger) 40, the cloth which should be sewed is sandwiched between the throat plate 42 and the presser foot which is pressed by the presser bar and is fed stitch by stitch by the feed dog mechanism, and stitches are formed on the cloth by the sewing machine needle 3 and the looper 44 as the loop capturing device.

This looper 44 as the loop capturing device and the feed dog mechanism are driven by each drive mechanism from the lower shaft 46 which is the drive shaft. On the other hand, the sewing machine needle 3 is fixed to the needle clamp 5 which is attached to the needle bar 58 which is driven by a needle bar drive mechanism 56 with the upper shaft 54 which is transmitted from the lower shaft 46 with rotation ratio of 1:1 by the lower shaft pulley 48, the timing belt 50 and the upper shaft pulley 52. The upper shaft 54 and the needle bar drive mechanism 56 are attached to a sewing machine arm. The throat plate 42, the looper 44 as the loop capturing device and the feed dog mechanism are attached to a sewing machine bed.

According to such the 2 needles and 4 threads hemstitch sewing machine (serger) 40, the cloth which should be sewed is sandwiched between the throat plate 42 and the presser foot which is pressed by the presser bar and is fed stitch by stitch by the feed dog mechanism, and stitches are formed on the cloth by the sewing machine needle 3 and the looper 44 as the loop capturing device. However, because the number, the specific structure and the operation of the throat plate 42 and the looper 44 as the loop capturing device for forming the stitches are public known or well known, the detailed explanations are omitted.

As shown in FIG. 2 (*a*)-FIG. 2 (*d*), FIG. 4 (*a*)-FIG. 4 (*d*) and FIG. 5 (*a*)-FIG. 5 (*d*), a feature of the present invention resides in the sewing machine needle clamping device 1 which attaches the sewing machine needle 3 to the accommodating recessed part 7 of the needle clamp 5. The needle clamp 5 has a fixing cylindrical portion 11 that the needle clamp 5 is fitted into the needle bar 58 and attached by the screw 9 and an attaching base 13 which extends from it up and down integrally. In addition, as this embodiment, although the needle clamp 5 may be attached as a separate part from the needle bar 58, the needle clamp 5 may be formed to and attached to the needle bar 5 integrally. The needle clamp 5 has above-mentioned accommodating recessed part 7 which accommodates the needle shank 15 of the sewing machine needle 3 in a central attaching portion 13*c* in the attaching base 13. The accommodating recessed part 7 and the attaching base 13 of the needle clamp 5 are arranged symmetrically one hy one with respect to a central longitudinal section of the needle clamp 5.

In two sewing machine needles 3, an end face of the shark of the needle shank 15 is butted against different attaching position of vertical direction in the inside of the needle clamp 5 respectively and an attaching flat surface 15*a* which is provided at the peripheral surface of the needle shank 15 of the sewing machine needle 3 is joined to an attaching flat surface 7*a* of the accommodating recessed part 7 in the inside of the needle clamp 5.

The needle clamp 5 has a clamp lever 19 which is freely opened and closed and is fixed to a clamp lever shaft 17 which is pivotally attached to an elongate hole 13*b* which is bored at an attaching portion 13*a* which is provided up and down in the attaching base 13 of the needle clamp 5 for the accommodating recessed part 7. When the clamp lever shaft 17 is pivotally attached in the elongate hole 13*b*, it can pivotally move, and is stopped so that it cannot move in the vertical direction. An elongate direction of the elongate hole 13*b* is same direction as a straight line L2 which links a central point N of the needle shank 15 of the sewing machine needle 3 which is accommodated in the accommodating recessed part 7 of the needle clamp 5 and a central point P of the clamp layer shaft 17 (FIG. 5 (*a*)) The clamp lever 19 has a clamp arm 21 which moves around without contacting on the peripheral surface of the needle shank 15 of the sewing machine needle 3.

In addition, the elongate hole 13*b* is formed in a deformed elongate hole and has three surfaces 13*d*, 13*e*, 13*f* that the cam follower 70 climbs over the cam 71 and moves as the movement path of the clamp lever shaft 17 which becomes the rotation center P of the clamp lever 19 (FIG. 5 (*e*)). The central point P of the clamp lever shaft 17 traces the central points P1, P2, P3 in the inside of the deformed elongate hole 13*b*. The three surfaces 13*d*, 13*e*, 13*f* intervene between arc surfaces 13*g*, 13*h*, 13*i* which are formed with same diameters as a radius "r" of the clamp lever shaft 17. As for these configurations of elongate holes 13*h*, the details are described later.

Besides, the needle clamp 5 has a plate-like needle clamp spring 23 which repels elastically the clamp lever 19 to an outer direction of the straight line which links the central point N of the needle shank 15 of the sewing machine needle 3 and the central point P of the clamp lever shaft 17.

In the sewing machine needle clamping device 1, the clamp arm 21 has a force acting locking part 22, which moves around without contacting on the peripheral surface of the needle shank 15 of the sewing machine needle 3 against the elasticity of the needle clamp spring 23 when swinging the clamp lever 19 to a clamping direction "a" (FIG. 4 (*b*)-FIG. 4 (*d*), FIG. 5 (*a*)-FIG. 5 (*d*)) in the state that the needle shank 15 of the sewing machine needle 3 is engaged to the accommodating recessed part 7 and butted against the attaching position 7*b* (FIG. 2 (*a*)) of the vertical direction, and which passes a branch point position tp (FIG. 5 (*c*)) that the elasticity of the needle clamp spring 23 becomes maximum, and which holds a stable clamping state by the elasticity of the needle clamp spring 23.

According to the sewing machine needle clamping device 1 of the present invention which is composed in this way, in the State before clamping the sewing machine needle 3 to the needle clamp 5 the needle shank 15 of the sewing machine needle 3, the clamp lever shaft 17 of the needle clamp 5 and the clamp arm 21 of the clamp lever 19 are positional relations shown in FIG. 4 (*a*).

According to the sewing machine needle clamping device 1 of the present invention, for example, the end face of the shank of the needle shank 15 of the sewing machine needle 3 is butted against different attaching position of vertical direction in the inside of the needle clamp 5 and the attaching flat surface 15*a* which is provided at the peripheral surface of the needle shank 15 of the sewing machine needle 3 is joined to the attaching flat surface 7*a* of the accommodating recessed part 7 in the inside of the needle clamp 5 by left hand and in the state immediately after clamping the clamp lever 13 to the clamping direction "a" by right hand, the clamp lever shaft 17 is repelled elastically and pressed to a hole surface of outside direction of the elongate hole 13*b* in the direction of the straight line which links the central point N of the needle shank 15 of the sewing machine needle 3 and the central point P of the clamp lever shaft 17 by the needle clamp spring 23 (FIG. 5 (*b*)).

According to the sewing machine needle clamping device 1 of the present invention, the end face of the shank of the needle shank 15 of the sewing machine needle 3 is butted against the attaching position of the vertical direction in the inside of the needle clamp 5 and the attaching flat surface 15*a* which is provided at the peripheral surface of the needle shank 15 of the sewing machine needle 3 is joined to the attaching flat surface 7*a* of the accommodating recessed part 7 in the inside of the needle clamp 5, and in the state after further continuing the clamping operation of the clamp lever 19 to the direction of the arrow "a", the tip 21*a* of the clamp arm 21 of the clamp lever 19, that is the force acting locking part 22 resists elastic repulsion of the needle clamp spring 23 for climbing over the needle shank 15 of the sewing machine needle 3 and moves to the direction of the needle shank 15 of the sewing machine needle 3 in the inside of the elongate hole 13*b* (FIG. 5 (*b*)).

According to the sewing machine needle clamping device 1 of the present invention, in the state that the end face of the shank of the needle shank 15 of the sewing machine needle 3 is butted against the attaching position of the vertical direction in the inside of the needle clamp 5, the attaching flat surface 15*a* which is provided at the peripheral surface of the needle shank 15 of the sewing machine needle 3 is joined to the attaching flat surface 7*a* of the accommodating recessed part 7 in the inside of the needle clamp 5 and completed the clamping operation of the clamp lever 19 to the direction of the arrow "a", in other worded in the clamping state, if the tip 21*a* of the clamp arm 21 of the clamp lever 19, that is, if the force acting locking part 22 climbs over the branch point position tp that elastic force of the needle clamp spring 23 becomes maximum, the curvature of the needle shank 15 of the sewing machine needle 3 and the curvature of the clamp arm 21 of the clamp lever 19 are corresponding, thereby the clamp lever shaft 17 returns toward the hole surface of outside direction of the elongate hole 13*b* in the direction of the straight line which links the central point N of the needle shank 15 of the sewing machine needle 3 and the central point P of the clamp lever shaft 17, and the central point C of the engagement surface 21*b* of the clamp arm 21 and the central point N of the needle shank 15 of the sewing machine needle 3 are corresponding (FIG. 5 (*d*)). As a result, the force F which repels elastically and presses the clamp lever shaft 17 to the direction of the central point N of the needle shank 15—the central point P of the clamp lever shaft 17 operates and the swing machine needle 3 is fixed stably by the needle clamp spring 23. The stable clamping state is held in this positional relation. As shown in FIG. 4 (*d*), in this state, the sewing machine needle 3, the needle clamp 5 and the clamp lever 19 are composed as sizes that the straight line L1 which links the central point C of the engagement surface 21*b* of the clamp arm 21 and the central point P of the clamp lever shaft 17 is corresponding to the straight line L2 which links the central point N of the needle shank 15 of the sewing machine needle 3 and the central point P of the clamp lever shaft 17. In addition, in other words, in this state, in the needle shank 15 of the sewing machine needle 3, the clamp lever shaft 17 of the needle clamp 5 and the clamp arm 21 of the clamp lever 19, the distance L1 which links the central point C of the engagement surface 21*b* of the clamp arm 21 and the central point P of the clamp lever shaft 17 is corresponding to the distance L2 which links the central point N of the needle shank of the sewing machine needle and the central point P of the clamp lever shaft. That is, it becomes L1=L2 (FIG. 5 (*d*)).

in the abovementioned swing machine needle clamping device 1, when the sewing machine needle is clamped, surface friction of each other is caused due to the engagements of many times of the face of the needle shank 15 that the maker name of the sewing machine needle 3 and the engraved mark are engraved and the convex part of the force acting locking part 22 of the clamp arm 21 and due to the difference between the material s of both at the time of the engagement, eventually, there is a possibility that the sewing machine needle 3 cannot be clamped to the needle clamp 5 certainly.

In the sewing machine needle clamping device 1 of the present invention, in order to eliminate the abovementioned disadvantages, as a premise, as mentioned above, the needle clamp 5 has the clamp lever 19 which is freely opened and closed for the accommodating recessed part 7 and is fixed to the clamp lever shaft 17 which is pivotally attached to the elongate hole 13*b* which is bored at the attaching portion 13*a* which is provided up and down in the attaching base 13 of the needle clamp 5. The clamp lever 19 has a clamp arm 21 which moves around without contacting on the peripheral surface of the needle shank 15 of the sewing machine needle 3. The clamp arm 21 has the force acting locking part 22, which moves around without contacting on the needle shank 15 of the sewing machine needle 3 against the elasticity of the needle clamp spring 23 when swinging the clamp lever 19 to a clamping direction "a" (FIG. 4 (*b*) FIG. 4 (*d*), FIG. 5 (*a*)-FIG. 5 (*d*)) in the state that the needle shank 15 of the sewing machine needle 3 is engaged to the accommodating recessed part 7 and butted against the attaching position 7*b* (FIG. 2 (*a*)) of the vertical direction, and which passes the branch point position tp (FIG. 5 (*c*)) that the elasticity of the needle clamp spring 23 becomes maximum, and which holds the stable clamping state by the elasticity of the needle clamp spring 23.

Besides, as shown in FIG. 4 (*a*)-FIG. 4 (*d*), FIG. 5 (*a*)-FIG. 5 (*d*), according to the sewing machine needle clamping device of the present invention, the cam 71 is provided in the needle clamp 5, the cam follower 70 which engages to the cam 71 is provided in the clamp arm 21, the elongate hole 13*b* is formed in the deformed elongate hole and has three surfaces 13*d*, 13*e*, 13*f* that the cam follower 70 climbs over the can 71 and moves as the movement path of the clamp lever shaft. 17 which becomes the rotation center P of the clamp lever 19 (FIG. 5 (*e*)). The central point P of the clamp lever shaft 17 traces the central points P1, P2, P3 in the inside of the deformed elongate hole 13*b*. The three surfaces 13*d*, 13*e*, 13*f* intervene between arc surfaces 13*g*, 13*b*, 13*i* Which are formed with same diameters as the radius "r" of the clamp lever shaft 17. In this way, the deformed elongate hole 13*b* is formed with the three surfaces 13*d*, 13*e*, 13*f* and inner peripheral surfaces of the arc surfaces 13*g*, 13*h*, 13*i*. Depending on closing of the clamp lever 19, according to the engagement between the cam follower 70 and the can 71 and elastic repulsion of the needle clamp spring 23, the central point P of the clamp lever shaft 17 passes the central points P1, P2 in the inside of the deformed elongate hole 13*b* and reaches a neighborhood of the central point P3, and reaches the central point P3 when the needle shank 15 of the sewing machine needle 3 is not attached to the accommodating recessed part 7 of the needle clamp 5, on the other hand, the clamp lever shaft 17 is designed to trace three surfaces 13*d*, 13*e*, 13*f* as its movement path. In addition, depending on opening of the clamp lever 19, the central point P of the clamp lever shaft 17 moves the central points P3, P2, P1 in the inside of the deformed elongate hole 13*b* conversely.

In this case, the above force acting locking part 22 passes, and the branch point position tp where the elasticity of the needle clamp spring 23 which holds the stable clamping stately the elasticity of the needle clamp spring 23 becomes maximum is a contact point between the cam follower 70 and the cam 71 when the central point P3 in the elongate hole 13*b* and the central point P of the clamp lever shaft 17 correspond. However, practically, to allow that the claw lever shaft 17 moves smoothly, the central point P3 is provided with, a certain clearance L3 toward the central point N from the central point P on the straight line L2 linking the central point N of the needle shank 15 and the central point P of the clamp lever shaft 17 (FIG. 5 (*c*)).

In this sewing machine needle clamping device 1, when swinging the clamp lever 19 at the time of clamping the sewing machine needle 3, till the state after continuing further clamping the sewing machine needle 3 to the needle clamp 5 via the state immediately after clamping the sewing machine needle 3 to the needle clamp 5 from the state before clamping the sewing machine needle 3 to the needle clamp 5, as the movement path of the clamp lever shaft 17 which becomes the rotation centers P1, P2 of the clamp lever 19 of the elongate hole 13*b*, the clamp lever shaft 17 moves the two surfaces 13*d*, 13*e* (FIG. 45 (*a*), FIG. 5 (*b*) (c)) whose central points P1, P2 of the elongate hole 13*b* that the cam follower 70 climbs over the cam 71 are curvature radii, and on the other hand, because the cam, follower 70 of the clamp arm 21 engages to the cam 71 of the needle clamp 5 (FIG. 4 (*a*), FIG. 4 (*b*) FIG. 4 (*c*)) and moves, the needle shank 15 of the sewing machine needle 3 and the clamp arm 21 do not contact, and in state which completes clamping the sewing machine needle 3 to the needle clamp 5, the elongate hole 13*b* reaches the surfaces 13*d*, 13*e*, 13*f* (FIG. 5 (*a*), FIG. 5 (*b*), FIG. 5 (*c*), FIG. 5 (*d*)) that the cam follower 70 climbs over the cam 71 and moves as the movement path of the clamp lever shaft 17 which becomes the rotation center P3 of the clamp lever 19, and engages to the needle shank 15 of the sewing machine needle 3 and the clamp arm 21 closely.

According to this sewing machine needle clamping device 1, this device can provide the basic merits that the mechanism is simplified and the operation is performed by one-touch operation of small number of times, and the sewing machine needle of such as the lock stitch sewing machine, the merger, the double chain stitch sewing machine, or the cover stitch sewing machine cam be attached, fixed or exchanged to the needle clamp firmly and easily, and in addition to the above basic merits, when the sewing machine needle is clamped, the wear-out due to the engagements of many times of the needle shank face that a maker name of the sewing machine needle and an engraved mark are engraved and a force acting locking part face of the clamp arm is eliminated, and the sewing machine needle can be clamped to the needle clamp certainly.

Besides, as shown in FIG. 6 (*a*)-FIG. 6 (*d*), in the sewing machine needle clamping device 1 of the present invention, a lock piece 72 is provided in the needle clamp 5 movably in the direction which is perpendicular to the direction of the axis of the sewing machine needle 3, and a lock piece stopper 73 which guides the lock piece 72 to the direction which is perpendicular to the direction of the axis of the sewing machine needle 3 is provided A clamp stopper 74 which prevents the opening of the clamp lever 19 by locking to the lock piece 72 when closing the clamp lever 19 is provided in the clamp lever 19, and a lock release button 75 which is housed slidably in the clamp lever 19 and releases the lock of the lock piece 72 and the clamp stopper 74 when opening the clamp lever 19 is provided in the clamp lever 19. The lock piece 72 is pressed to the clamp side by a, coil spring 72*a*.

When the clamp lever 19 places in the clamp position, the lock piece 72 is locked to the clamp stopper 74, and the clamp lever 19 cannot be released (FIG. 6 (*a*)-FIG. 6 (*b*)). The lock piece 72 is released from the lock stopper 74 by pressing the lock release button 75 to the lever and the clamp can be opened (FIG. 6 (*c*)-FIG. 6 (*d*)).

According to the sewing machine needle clamping device 1 of the present invention, in addition to the above basic merits, when the clamp lever 19 is closed, the clamp lever 19 is opened by the unintentional movement in the lateral direction and/or the back-and-forth, direction of the sewing machine needle 3 and the malfunction that clamping of the needle is released occurs, and this device can function as a safety device which prevents that the sewing machine needle 3 breaks and disperses by the collision to other parts.

Figure 7:
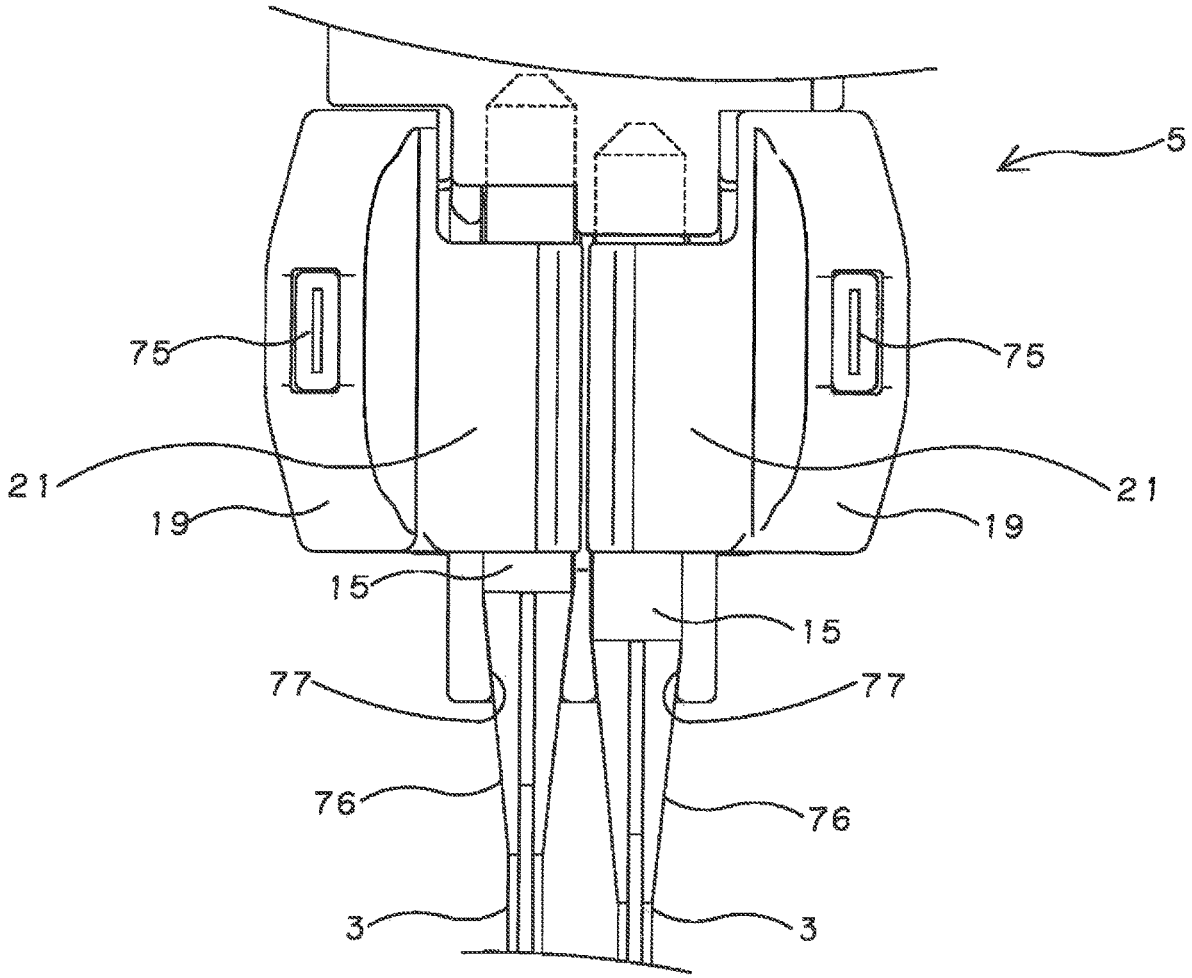
FIG. 7 A partial enlarged view of the front view of the sewing machine needle clamping device of the present invention which clamps the sewing machine needle to the needle clasp certainly and prevents the needle from slipping out.

Besides, as shown in FIG. 2 (*a*), FIG. 7 in the sewing machine needle clamping device 1 of the present invention which attaches the sewing machine needle 3 to the accommodating recessed part 7 of the needle clamp 5, the needle clamp 5 which attaches the sewing machine needle 3 is formed in the outer shape of the needle shank 15 of the sewing machine needle, especially is formed in the inner shape 77 which adjusts to a shank taper 76 to prevent that the sewing machine needle slips out of the needle clamp 5 when the sewing machine needle 3 penetrates into the cloth which is used for a sports bag which is coated by such as PVC or PU on the cloth, or the leather that the needle is hard to pierce, in other words, when the sewing machine needle 3 penetrates into the cloth which has the large friction and then the sewing machine needle 3 come out of the cloth.

Generally, when the sewing machine needle 3 penetrates into the cloth that the needle is hard to pierce, and then the sewing machine needle 3 come out of the cloth, the force works in the direction which slips out from the needle clamp 5 by the frictional force with the cloth. Although the inner shape 77 of a taper groove of approximate shape with the shank taper 76 of the sewing machine needle 3 is provided in an outlet aide of a needle attaching groove of the needle clamp this is a taper shape which is clearance in the extent that a timing position that a needle eye position scoops a needle thread by a lower looper low-taker point does not influence even if the sewing machine needle 3 moves to the direction of slipping out.

According to the sewing machine needle clamping device 1 of the present invention, in addition to the above basic merits, when the sewing machine needle penetrates into the cloth that the needle is hard to pierce, in other words, when the sewing machine needle penetrates into the cloth which has the large friction, and then the sewing machine needle come out of the cloth this device can prevent that the sewing machine needle slips out of the needle clamp by the frictional force with the cloth.

Figure 8A:
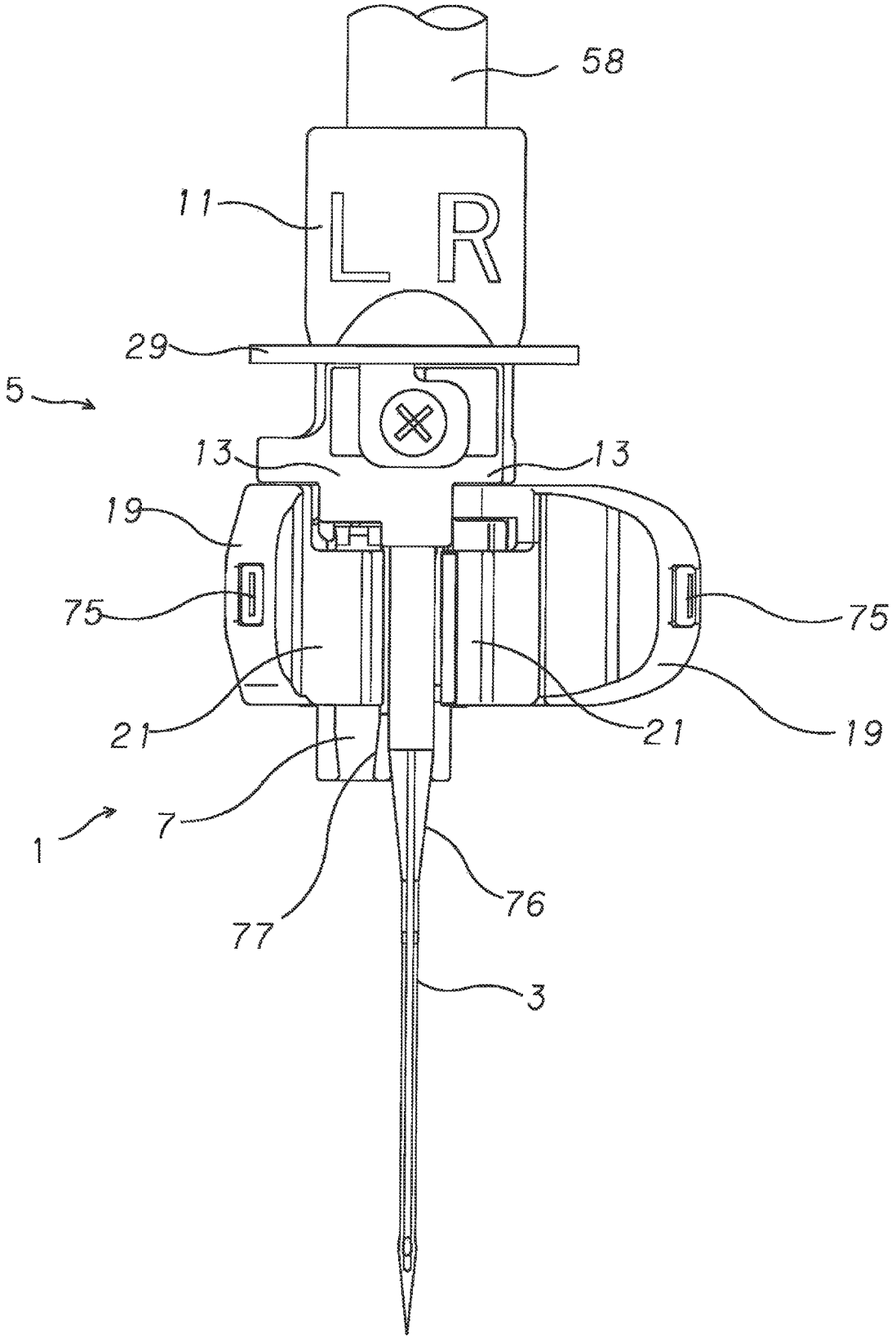
FIG. 8 (A) A front view of the sewing machine needle clamping device of the present invention which prevents forgetting clamping of the sewing machine needle.
Figure 8B:
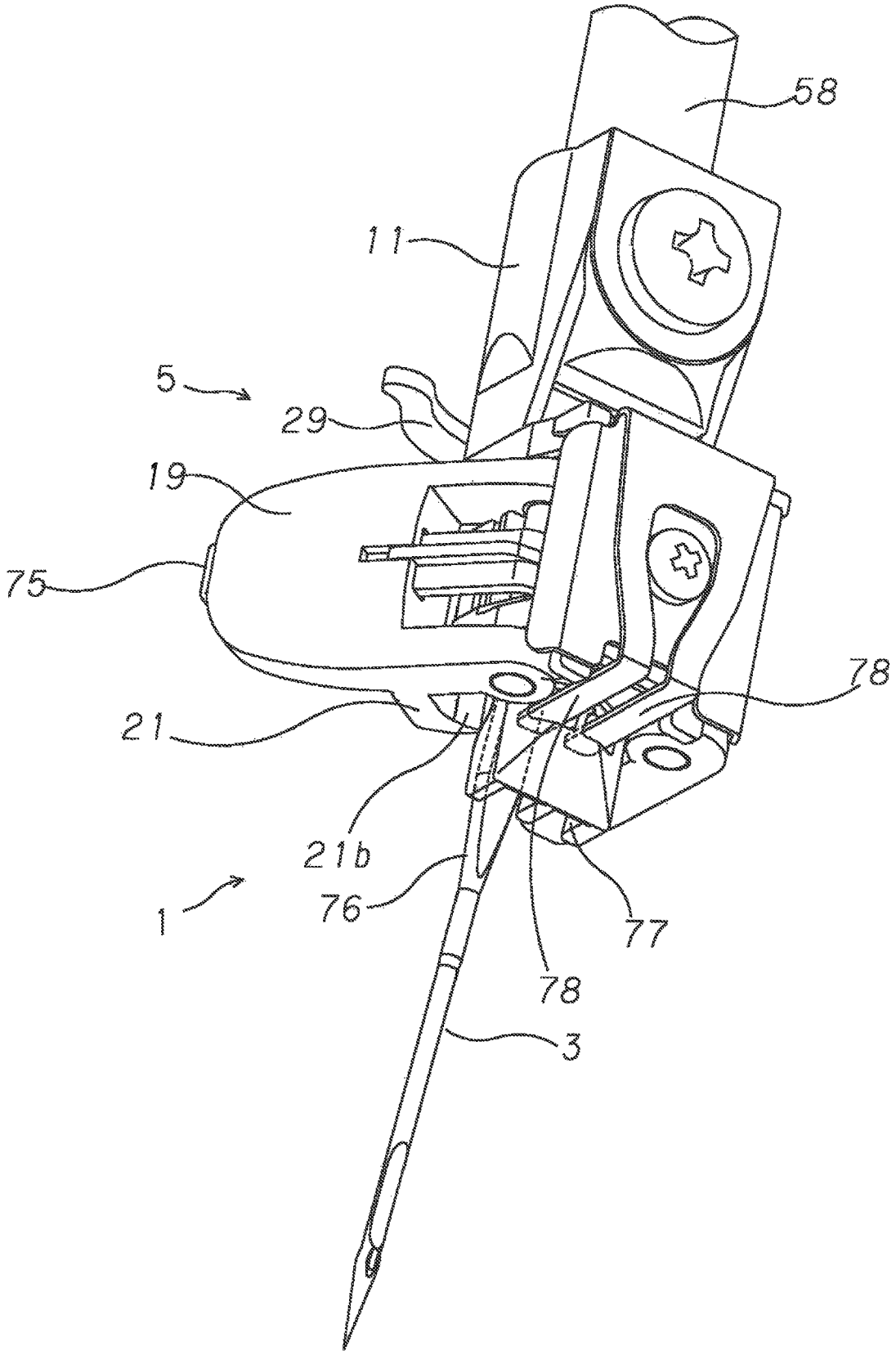
Figure 9A:
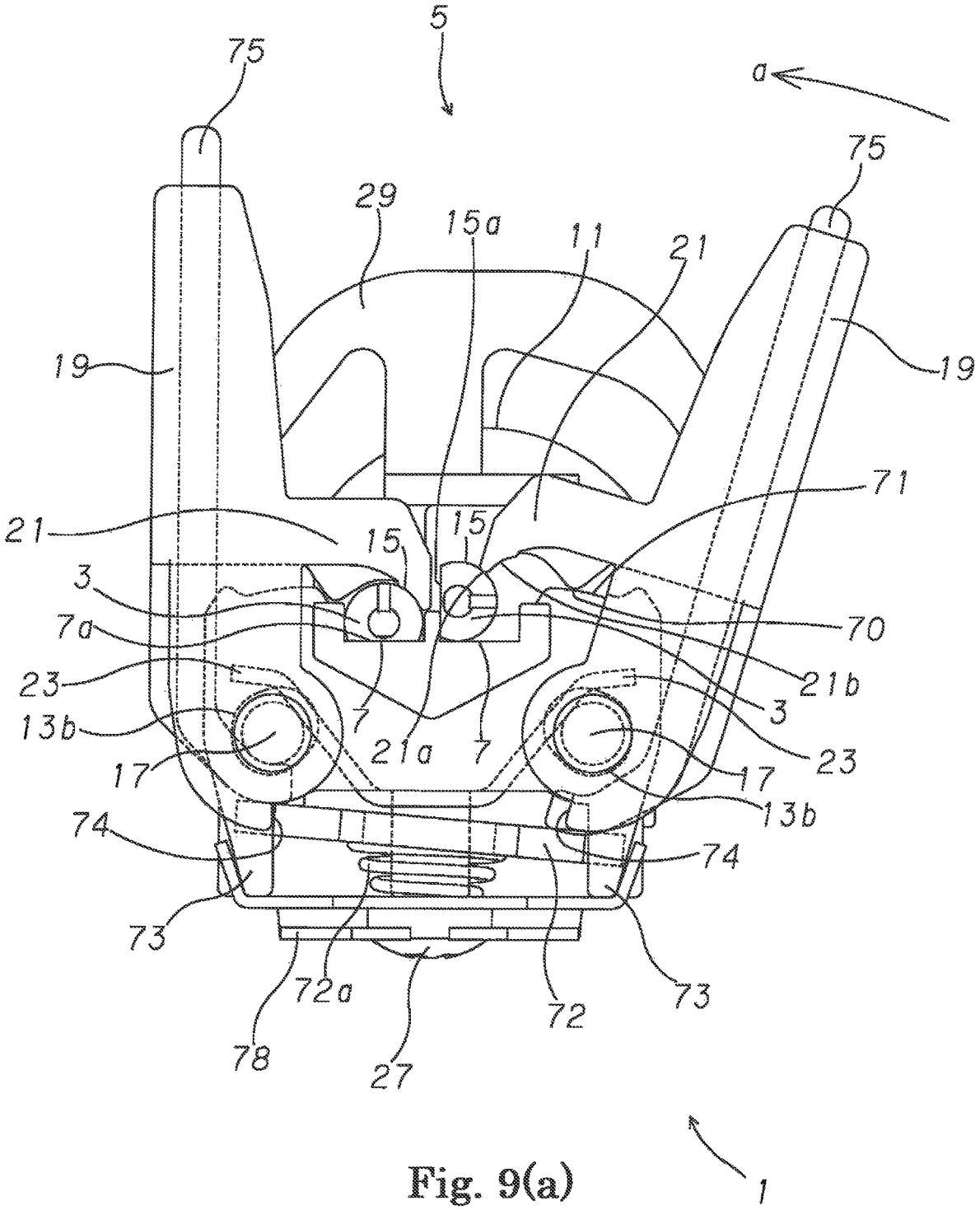
FIG. 9 (*a*) A bottom, view of the sewing machine needle clamping device of the present invention which performs an orientation work of the sewing machine needle certainly when clamping the sewing machine needle to the needle clamp certainly.
Figure 9B:
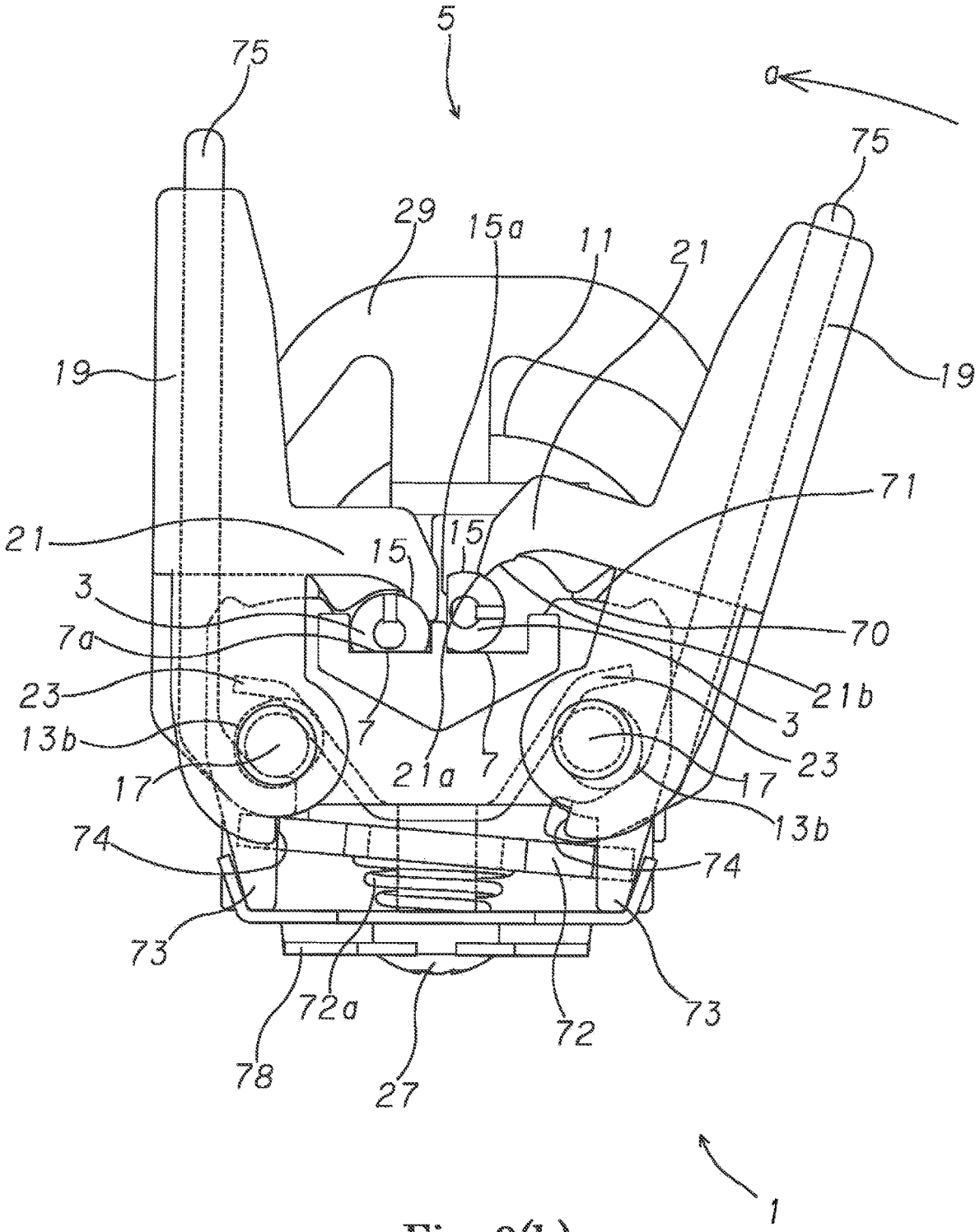
Figure 9C:
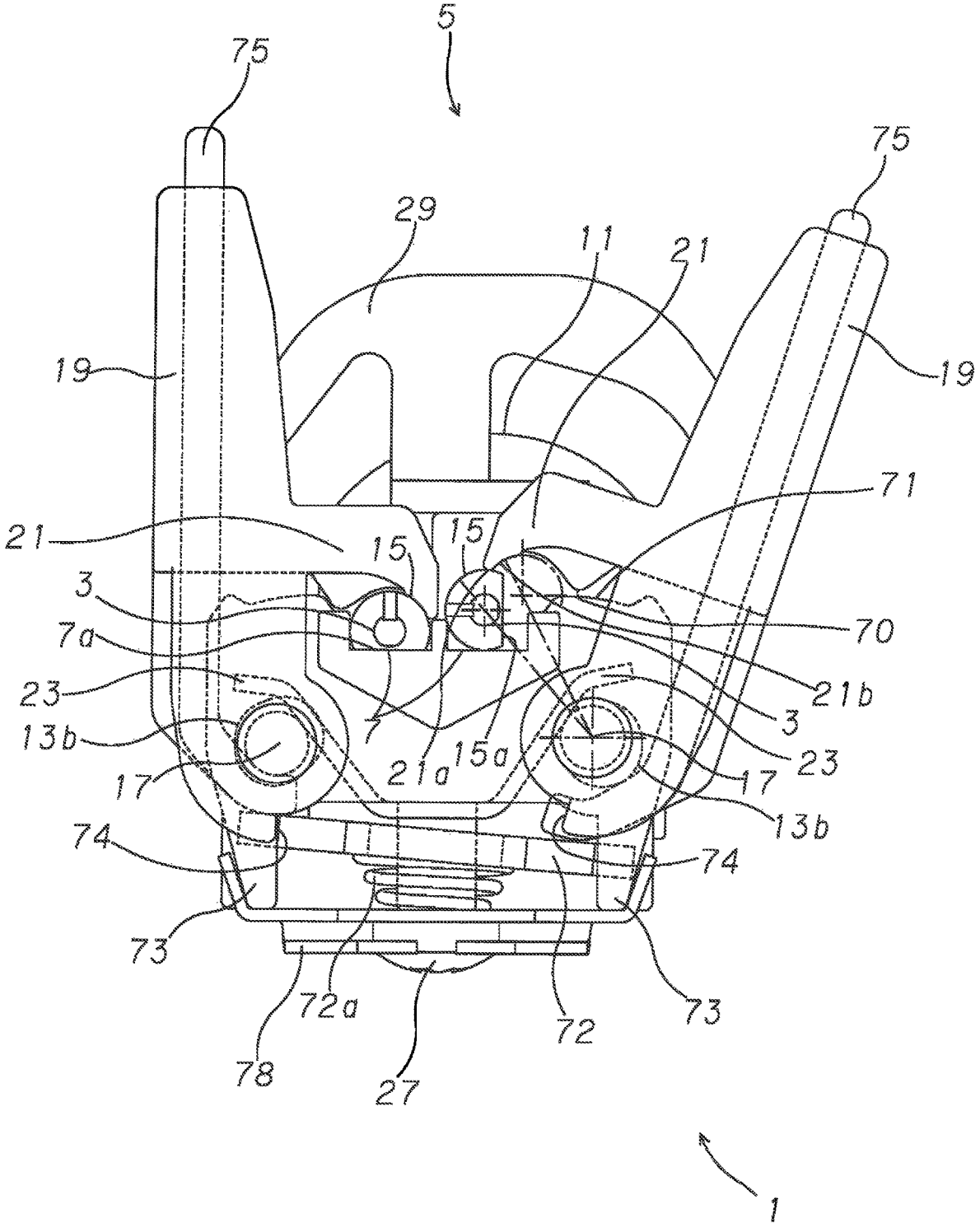
Figure 9D:
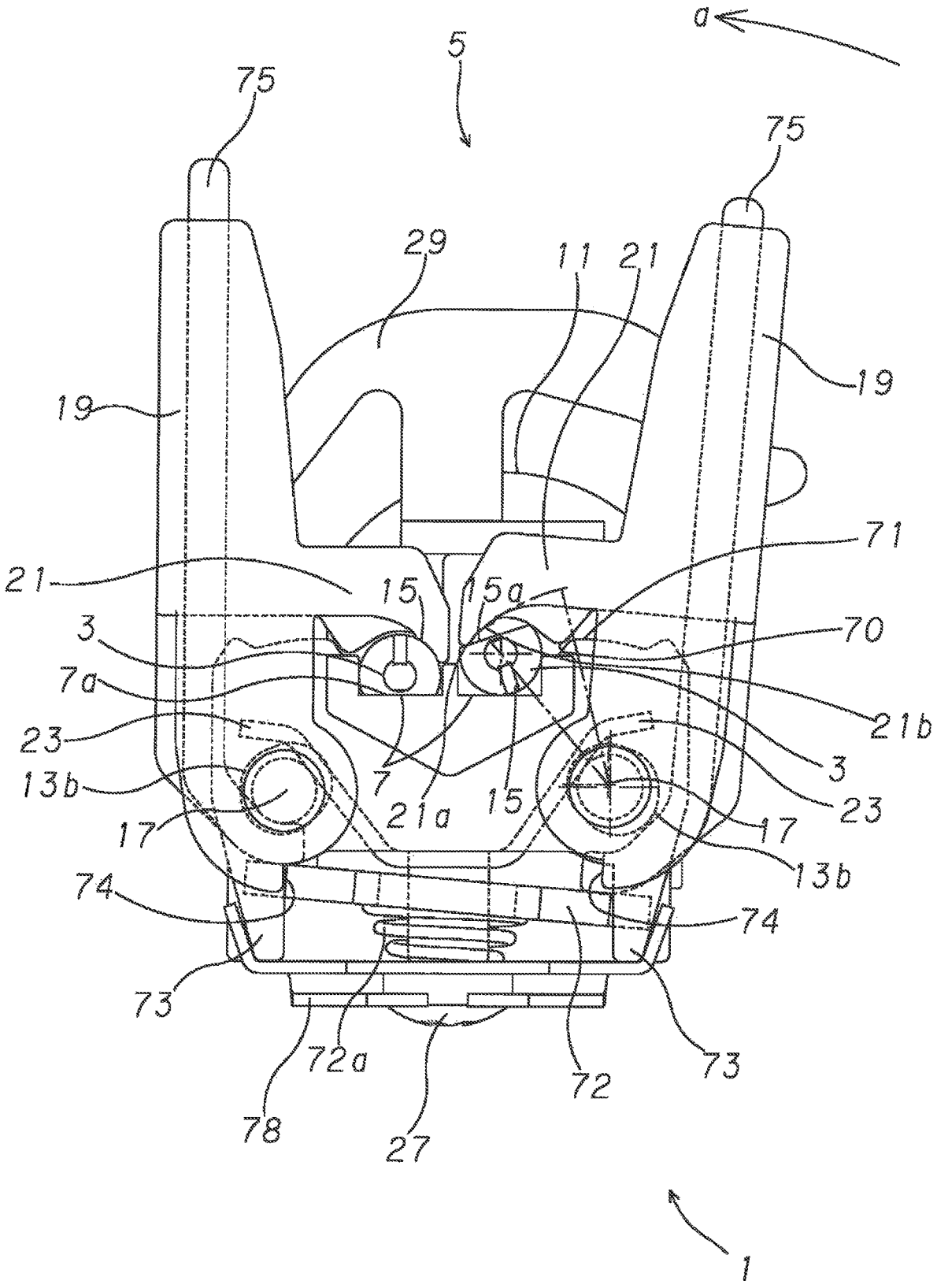
Figure 9E:
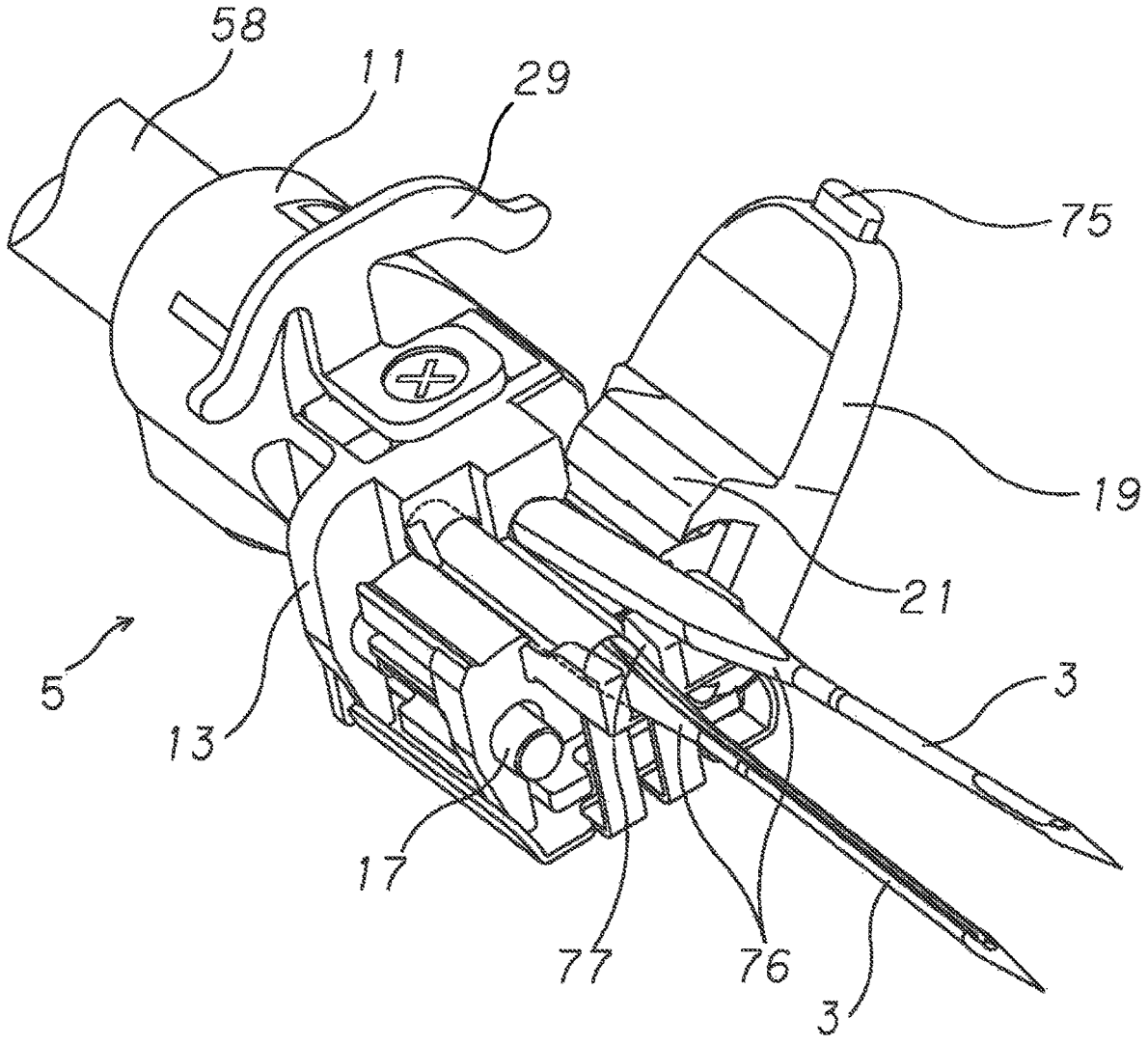
Figure 9F:
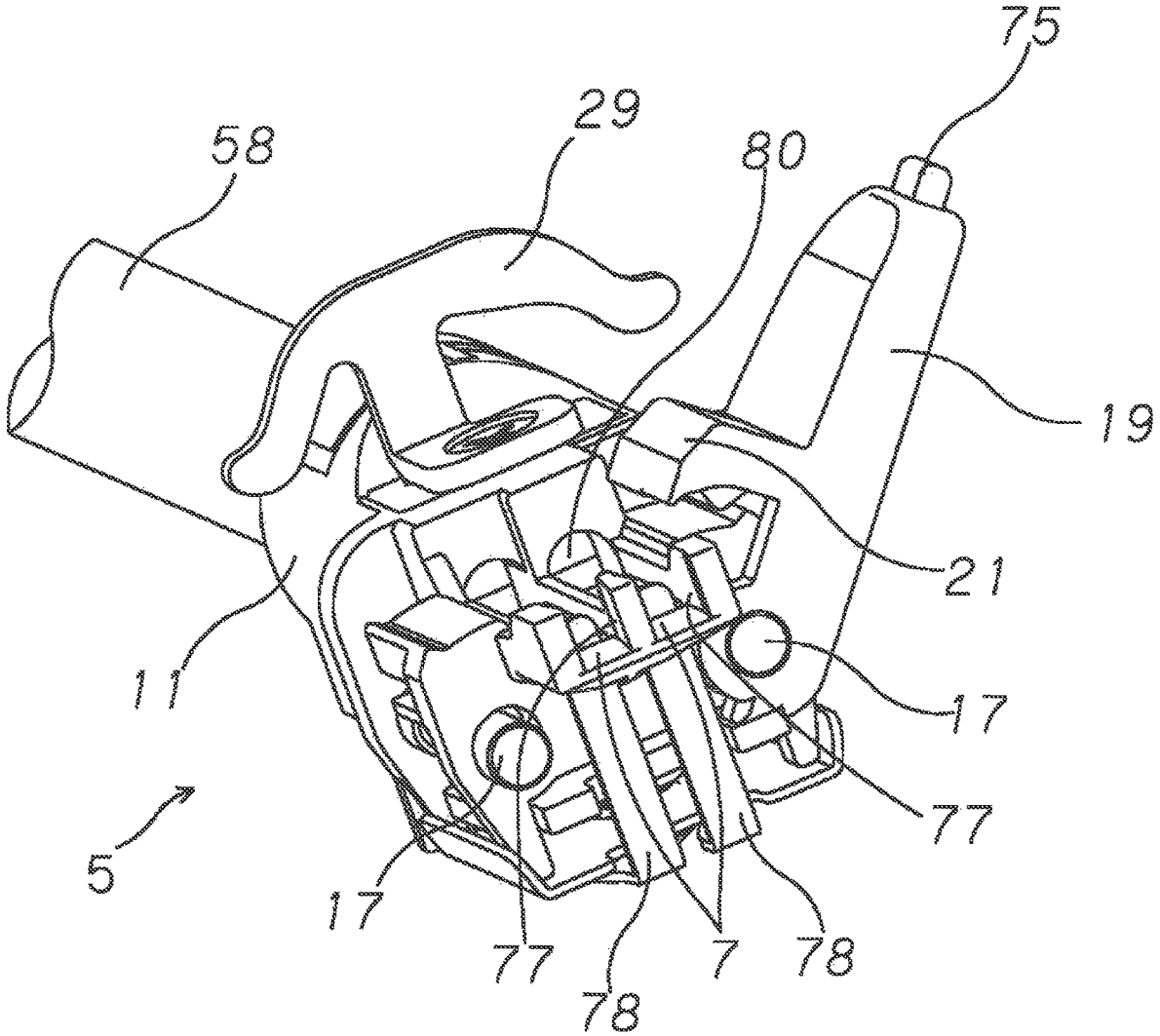
Figure 9G:
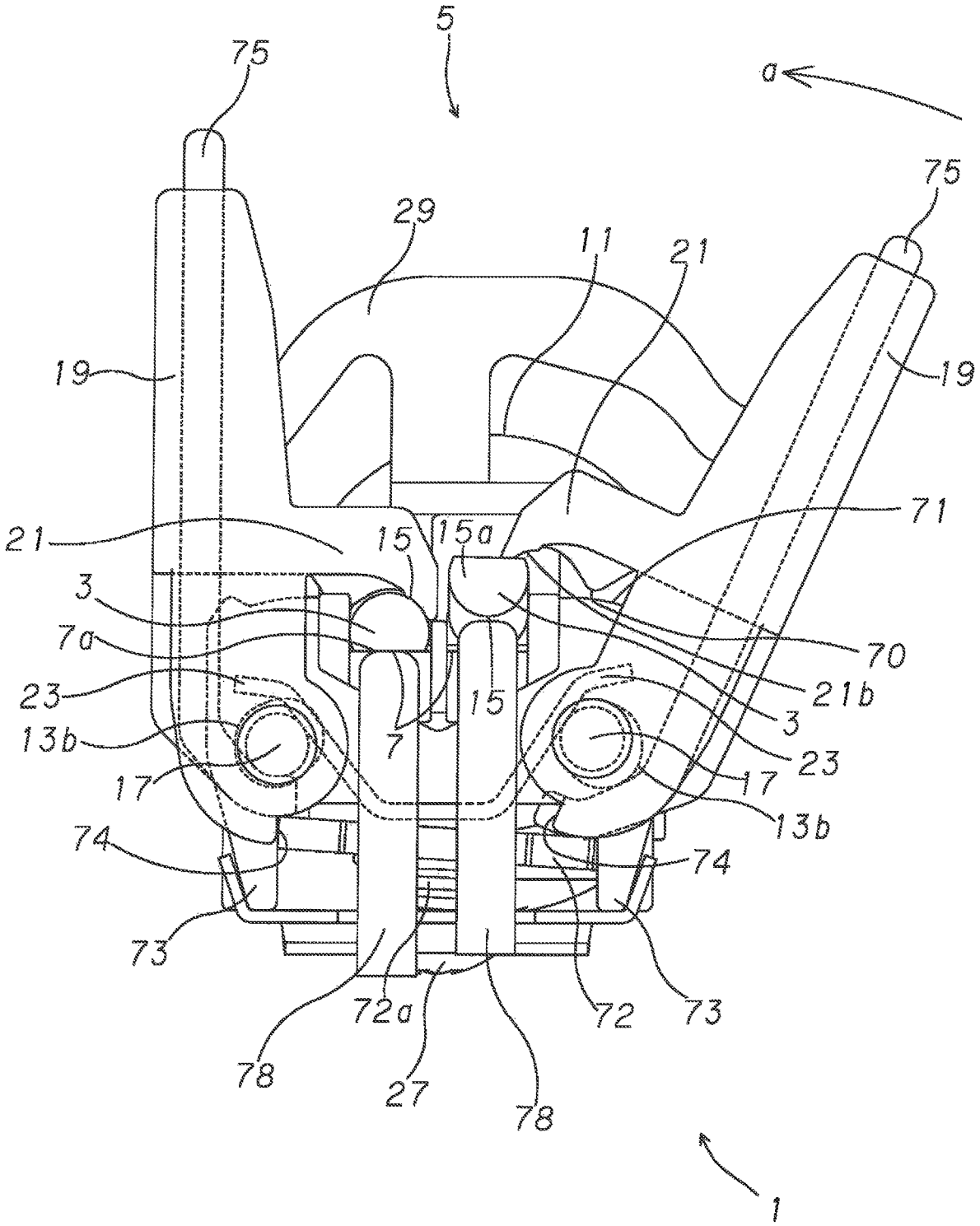

Besides as shown in FIG. 8 (*a*), FIG. 8 (*b*), in the sewing machine needle clamping device 1 of the present invention, when the clamp lever 19 is opened, a L-shaped needle clamp forgetting prevention spring 78 which repels elastically the sewing machine needle 3 to the direction that the sewing machine needle 3 separates from the accommodating recessed part 7 is provided in the needle clamp 5 which attaches the sewing machine needle 3.

As mentioned above, because the inner shape 77 of the taper groove of approximate shape with the shank taper 76 of the sewing machine needle 3 is provided as the taper for preventing the needle from slipping out in the outlet side of the needle attaching groove of the needle clamp 5, the sewing machine needle 3 does not fall off when attaching the sewing machine needle 3 to the needle clamp 5. Therefore, there is a possibility to forget a clamping operation. When the clamping operation is not performed, because the sewing machine needle 3 is pushed out in the direction which detaches from the taper groove by repelling elastically the sewing machine needle 3 from a back side of the sewing machine needle 3, the sewing machine needle 3 falls off.

According to the sawing machine needle clamping device 1 of the present invention, in addition to the above basic merits, when the sewing machine needle 3 is attached to the needle clamp 5, the safety device which does not drop the sewing machine needle 3 is provided. On the other hand, when the clamp lever 19 is opened, clamping forgetting prevention can be attempted because the sewing machine needle 3 drops from the accommodating recessed part 7.

Besides, as shown in FIG. 9 (*a*)-FIG. 9 (*g*), in the sewing machine needle clamping device 1 of the present invention, the needle clamp 5 which attaches the sewing machine needle 3 is composed to be able to attach the sewing machine needle 3 at the time of the direction of the attachment of the sewing machine needle 3 where the attaching hole 80 which adjusts to a D-shaped cross-sectional shape 79 including the attaching flat surface 15*a* of the upper end of the needle shank 15 of the sewing machine needle 3 is formed and the attaching flat surface 15*a* of the needle shank 15 is joined to the attaching flat surface 7*a* of the accommodating recessed part 7. In addition, when the per end of the needle shank 15 of the sewing machine needle 3 is not fitted into the attaching hole 90 of the shape which adjusts to the D-shaped cross-sectional shape 79 including the attaching flat surface 15*a*, because the shank taper 76 of the sewing machine needle 3 does not fit into the portion of the inner shape 77 of the needle clamp 5, the sewing machine needle 3 cannot be attached to the accommodating recessed part 7 at this point (FIG. 9 (*e*)$^{w}$ FIG. 9 (*g*)).

That is, in the direction of the attachment of the sewing machine needle 3, the shank surface becomes the needle clamp body side. In the attaching bole 80 of the needle clamp 5, because the portion where the upper end of the needle shank 15 enters becomes the D-shaped cross-sectional shape 79, in the case that the needle shank 15 is not a normal direction, as mentioned above, the sewing machine needle 3 cannot fit into the attaching hole 80 and the force acting locking part (clamp tip) 22 cannot also climb over the needle shank 15, thereby the clamping operation cannot be performed.

However, when the direction of the attaching flat surface 15*a* of the needle shank 15 of the sewing machine needle 3 is the position which is shown in FIG. 9 (*a*)-FIG. 9 (*e*), in also the case that the needle shank 15 of the sewing machine needle 3 is not fitted into the attaching hole 80 and is not fitted into the attaching flat surface 7*a* of the accommodating recessed part 7 of the needle clamp 5 and floats up, if the clearance L3 increases, the tip 21*a* of the clamp arm climbs over the needle shank 15. Therefore, the clearance L3 should be made small.

According to the sewing machine needle clamping device 1 of the present invention, in addition to the above basic merits, the sewing machine needle casaba attached to the accommodating recessed part only when the direction of the needle where the attaching flat surface of the needle shank is joined to the attaching flat surface of the accommodating recessed part is attached, and the attachment can be performed certainly.

As it is clear from the above explanation, according to the sewing machine needle clamping device of the present invention, the operation which has to screw the thin sewing machine needle by the screw to the needle clamp of small apace firmly by the screwdriver is unnecessary and the mechanism is simplified and the operation is performed by one-touch operation of small number of times, and the sewing machine needle such as the lock, stitch sewing machine, the serger, the double chain stitch sewing machine, or the cover stitch sewing machine can be attached, fixed or exchanged to the needle clamp firmly and easily, and when the clamp lever is closed, the clamp lever is opened by the unintentional movement in the lateral direction and the back-and-forth direction of the needle and the malfunction that clamping of the needle is released occurs, and this device can function as the safety device which prevents that the sewing machine needle breaks and disperses by the collision to other parts, and when the sewing machine needle penetrates into the cloth that the needle is hard to pierce, in other words, when the sewing machine needle penetrates into the cloth which has the large friction and then the sewing machine needle come out of the cloth, this device can prevent that the sewing machine needle slips out of the needle clamp by the frictional force with the cloth, and when the needle is attached to the needle clamp, the safety device which does not drop the sewing machine needle is provided. On the other hand, when the clamp lever is opened, the prevention to forget clamping can be attempted because the sewing machine needle drops from the accommodating recessed part, end the sewing machine needle can be attached to the accommodating recessed part only when the direction of the sewing machine needle where the attaching flat surface of the needle shelf is joined to the attaching flat surface of the accommodating recessed part is attached, and the attachment can be performed certainly.

INDUSTRIAL APPLICABILITY

Because the sewing machine needle is attached and fixed to the needle clamp firmly and easily, the sewing machine needle clamping device in the present invention can be applied suitably to various types of the sewing machine such as the lock stitch sewing machine, the serger, the double chain stitch sewing machine, or the cover stitch swing machine.

EXPLANATION OF THE NUMERALS

1 sewing machine needle clamping device
3 sewing machine needle
5 needle clamp
7 accommodating recessed part
7*a* attaching flat surface
9 screw
11 fixing cylindrical portion
13 attaching base
13*a* attaching portion
13*b* elongate hole
13*c* attaching portion of vertical direction
13*d*, 13*e*, 13*f* surface
15 needle shank
15*a* attaching flat surface
17 clamp lever shaft
19 clamp lever
21 clamp arm
21*a* tip of clamp arm
21*b* engagement surface
22 force acting locking part
23 needle clamp spring
27 screw
40 hemstitch sewing machine (serger)
42 throat plate
44 looper as loop capturing device
46 lower shaft
48 lower shaft pulley
50 timing belt
52 upper shaft pulley
54 upper shaft
56 needle bar drive mechanism
70 needle bar
71 cam follower
72 cam
72 lock piece
73 lock piece stopper
74 clamp stopper
75 lock release button
76 outer shape (shank taper)
77 inner shape
78 needle clamp forgetting prevention spring
79 D-shaped cross-sectional shape
80 attaching bole
a clamping direction
L1 straight-line distance which links central point of engagement surface of clamp arm and central point of clamp lever shaft
L2 straight-line distance which links central point of needle shank and central point of clamp lever shaft
L3 clearance between P3 and P
C central point of engagement surface of clamp arm
N central point of needle shank
P central point of clamp lever shaft
P1, P2, P3 central point
tp branch point position

The invention claimed is:

1. A sewing machine needle clamping device for attaching a sewing machine needle to an accommodating recessed part of a needle clamp, comprising:

said needle clamp having, the accommodating recessed part accommodating a needle shank of the sewing machine needle by joining an attaching flat surface to a bottom portion, a swingable clamp lever having a clamp arm engaging to the needle shank of said sewing machine needle, being freely opened and closed for said accommodating recessed part and being fixed to a clamp lever shaft being fitted loosely into an elongate hole being bored at said needle clamp, and a needle clamp spring repelling elastically said clamp lever to an outer direction of a straight line linking a central point of the needle shank of said sewing machine needle and a central point of said clamp lever shaft, wherein said clamp arm has a force acting locking part, moving around on a peripheral surface of the needle shank of said sewing machine needle against the elasticity of said needle clamp spring when swinging said clamp lever to a clamping direction in the state that the needle shank of said sewing machine needle is engaged to said accommodating recessed part and butted against an attaching position of a vertical direction, passing a branch point position that the elasticity of said needle clamp spring becomes maximum, and holding a stable clamping state by the elasticity of said needle clamp spring, a cam is provided in said needle clamp, a cam follower which engages to said cam is provided in said clamp arm, and said elongate hole has three surfaces that said cam follower climbs over said cam and moves as a movement path of said clamp lever shaft which becomes a rotation center of said clamp lever.

2. A sewing machine needle clamping device according to claim 1, wherein:

a lock piece is provided in said needle clamp movably in a direction which is perpendicular to the direction of an axis of said needle, and a lock piece stopper which guides said lock piece to a direction which is perpendicular to a direction of an axis of said sewing machine needle is provided, a clamp stopper which prevents the opening of said clamp lever by locking to said lock piece when closing said clamp lever is provided in said clamp lever, and a lock release button which releases the lock of said lock piece and said clamp stopper when opening said clamp lever is provided in said clamp lever.

3. A sewing machine needle clamping device for attaching a sewing machine needle to an accommodating recessed part of a needle clamp, comprising:

said needle clamp having, the accommodating recessed part accommodating a needle shank of the sewing machine needle by joining an attaching flat surface to a bottom portion, a swingable clamp lever having a clamp arm engaging to the needle shank of said sewing machine needle, being freely opened and closed for said accommodating recessed part and being fixed to a clamp lever shaft being fitted loosely into an elongate hole being bored at said needle clamp, and a needle clamp spring repelling elastically said clamp lever to an outer direction of a straight line linking a central point of the needle shank of said sewing machine needle and a central point of said clamp lever shaft, wherein said clamp arm has a force acting locking part, moving around on a peripheral surface of the needle shank of said sewing machine needle against the elasticity of said needle clamp spring when swinging said clamp lever to a clamping direction in the state that the needle shank of said sewing machine needle is engaged to said accommodating recessed part and butted against an attaching position of a vertical direction, passing a branch point position that the elasticity of said needle clamp spring becomes maximum, and holding a stable clamping state by the elasticity of said needle clamp spring, said needle clamp which attaches said sewing machine needle is formed in an inner shape which adjusts to said needle shank or an outer shape of said needle to prevent that said needle slips out of said needle clamp when said needle penetrates into a cloth and then said needle come out of said cloth.

4. A sewing machine needle clamping device according to claim 3, wherein:

a needle clamp forgetting prevention spring which repels elastically said needle to a direction that said needle separates from said accommodating recessed part is provided in said needle clamp which attaches said sewing machine needle when said clamp lever is opened.

5. A sewing machine needle clamping device according to claim 1, wherein:

an attaching hole which adjusts to a D-shaped cross-sectional shape including an attaching flat surface of an upper end of said needle shank of said needle is formed to be able to attach said sewing machine needle at the time of a direction of the attachment of said needle where said attaching flat surface of said needle shank is joined to said attaching flat surface of said accommodating recessed part in said needle clamp which attaches said sewing machine needle.

6. A sewing machine needle clamping device according to claim 3, wherein:

an attaching hole which adjusts to a D-shaped cross-sectional shape including an attaching flat surface of an upper end of said needle shank of said needle is formed to be able to attach said sewing machine needle at the time of a direction of the attachment of said needle where said attaching flat surface of said needle shank is joined to said attaching flat surface of said accommodating recessed part in said needle clamp which attaches said sewing machine needle.

* * * * *